US009990883B2

(12) United States Patent
Park et al.

(10) Patent No.: US 9,990,883 B2
(45) Date of Patent: Jun. 5, 2018

(54) ORGANIC LIGHT EMITTING DISPLAY AND DRIVING METHOD THEREOF

(71) Applicant: LG Display Co., Ltd., Seoul (KR)

(72) Inventors: Youngju Park, Seoul (KR); Sungwook Yoon, Gyeonggi-do (KR); Sehwan Na, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days. days.

(21) Appl. No.: 15/226,047

(22) Filed: Aug. 2, 2016

(65) Prior Publication Data

US 2017/0061878 A1 Mar. 2, 2017

(30) Foreign Application Priority Data

Aug. 31, 2015 (KR) ..... 10-2015-0123253

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0852* (2013.01); *G09G 2300/0861* (2013.01); *G09G 2310/0251* (2013.01); *G09G 2310/0262* (2013.01)

(58) Field of Classification Search
CPC ..... G09G 3/3233
USPC ..... 345/76
See application file for complete search history.

(56) References Cited

U.S. PATENT DOCUMENTS 7,710,368 B2 * 5/2010 Chung ..... G09G 3/3233 345/76
2010/0188316 A1 * 7/2010 Jang ..... G09G 3/3266 345/76
2011/0273418 A1 * 11/2011 Park ..... G09G 3/3208 345/211
2013/0162617 A1 * 6/2013 Yoon ..... G09G 3/3291 345/211
2014/0152633 A1 * 6/2014 Park ..... G09G 3/3291 345/207
2014/0184665 A1 * 7/2014 Yoon ..... G09G 3/3241 345/691
2016/0275845 A1 * 9/2016 Tsai ..... G09G 3/3266

* cited by examiner

*Primary Examiner* — Koosha Sharifi-Tafreshi
(74) *Attorney, Agent, or Firm* — Morgan, Lewis & Bockius LLP

(57) ABSTRACT

An organic light emitting display comprises a display panel having data lines, scan lines, emission signal lines, and pixels. The display also comprises a data driver configured to provide a data voltage corresponding to an input image to one of the data lines connected to a pixel and a gate driver configured to provide an N-th scan pulse to an N-th scan line to charge the pixel with the data voltage during a scan period within a frame period. The display further comprises an emission driver configured to receives shift clocks and the N-th scan pulse from the gate driver to provide an N-th emission control signal to the N-th emission signal line and to control a current path through the OLED based on the N-th emission control signal during a duty driving period following the scan period within a frame period.

17 Claims, 14 Drawing Sheets

(a)

(b)

ORGANIC LIGHT EMITTING DISPLAY AND DRIVING METHOD THEREOF

This application claims the benefit of Korean Patent Application No. 10-2015-0123253 filed on Aug. 31, 2015, the entire contents of which are incorporated herein by reference for all purposes as if fully set forth herein.

BACKGROUND OF THE INVENTION

Field of the Invention

The present disclosure relates to an organic light emitting display enabling duty control for turning on and off pixels, and a driving method of the organic light emitting display.

Discussion of the Related Art

An active-matrix organic light emitting display includes Organic Light Emitting Diodes (OLEDs). It has an advantage of providing a fast response speed with high light-emitting efficiency and luminance, and a wide viewing angle. An OLED includes an organic compound layer formed between an anode and a cathode. The organic compound layer is made of a hole injection layer (HIL), a hole transport layer (HTL), an emission layer (EML), an electron transport layer (ETL), and an electron injection layer (EIL). If a driving voltage is applied to the anode and the cathode, a hole passed through the HTL and an electrode passed through the ETL move to the EML to form an exciton. As a result, the EML generates a visible light.

An OLED display device may be driven in a duty driving method. In order to implement the duty driving method, an emission control signal (hereinafter, an "EM signal") is applied to pixels. The EM signal is applied at an ON level or an OFF level. The ON level defines a time of turning on the pixels, and the OFF level defines a time of turning off the pixels. In the case of an n-type Metal Oxide Semiconductor Field Effect Transistor (MOSFET), the ON level is a high logic level, and the OFF level is a low logic level. A Pulse Width Modulation (PWM) duty ratio of an EM signal defines times of turning on and turning off the pixels.

To implement the duty driving method, the OLED display device comprises an EM driver capable of switching from ON level to OFF level or vice versa in the desired time. The EM driver may be driven in response to an output of a gate driver. However, since the output of the gate driver is synchronized with data to be written to pixels, it is not possible to control the EM signal to be in the OFF level for a desired amount of time independent of the data. In addition, because a conventional EM driver generates an output in a clock timing, it cannot generate an EM signal with a duty ratio of 50% or greater. Therefore, there is a need for an EM driver which is capable of implementing the duty driving method.

SUMMARY OF THE INVENTION

Accordingly, the present invention is directed to an organic light emitting display and a driving method of the organic light emitting display that substantially obviate one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting display comprises: a display panel having a plurality of data lines, a plurality of scan lines crossing the data lines, a plurality of emission signal lines, and a pixel connected to an N-th scan line and an N-th emission signal line, where N is a positive integer; a data driver configured to provide a data voltage corresponding to an input image to one of the data lines connected to the pixel; a gate driver configured to provide an N-th scan pulse to the N-th scan line to charge the pixel with the data voltage during a scan period within a frame period; and an emission driver configured to receives shift clocks and the N-th scan pulse from the gate driver to provide an N-th emission control signal to the N-th emission signal line and to control a current path through the OLED based on the N-th emission control signal during a duty driving period following the scan period within a frame period. The pixel includes an organic light emitting diode (OLED), and a first pixel TFT connected to the OLED and configured to control an amount of current to flow through the OLED based on a voltage between a gate and a source of the first pixel TFT. The voltage between the gate and the source of the first pixel TFT is configured to remain substantially constant during the duty driving period.

In another aspect, an organic light emitting display comprises: a display panel having a plurality of data lines, a plurality of scan lines crossing the data lines, a plurality of emission signal lines, and a pixel connected to an N-th scan line and an N-th emission signal line, where N is a positive integer; a timing controller configured to receive an input image data and timing signals from a host system, and to output a data timing control signal, a gate timing control signal, and a plurality of duty timing control signals; a data driver configured to provide a data voltage corresponding to the input image data to one of the data lines connected to the pixel based on the data timing control signal; a gate driver configured to provide a data-writing scan pulse to the N-th scan line based on the gate timing control signal to charge the pixel with the data voltage during a scan period within a frame period; and an emission driver configured to generate an N-th scan pulse independently of the gate driver, and to provide an N-th emission control signal to the N-th emission signal line based on the N-th scan pulse and at least one of the duty timing control signals, during a duty driving period following the scan period within the frame period.

In yet another aspect, an organic light emitting display comprises: a display panel having a plurality of data lines, a plurality of scan lines crossing the data lines, a plurality of emission signal lines, and a pixel connected to an N-th scan line and an N-th emission signal line, where N is a positive integer; a timing controller configured to receive an input image data and timing signals from a host system, and to output a data timing control signal, a gate timing control signal, and a plurality of duty timing control signals; a data driver configured to provide a data voltage corresponding to the input image data to one of the data lines connected to the pixel based on the data timing control signal; a gate driver configured to provide a data-writing scan pulse to the N-th scan line based on the gate timing control signal to charge the pixel with the data voltage during a scan period within a frame period; and an emission driver configured to provide an N-th emission control signal to the N-th emission signal line based on at least one of the duty timing control signals during a duty driving period following the scan period within the frame period. The N-th emission control signal is a pulse width modulated signal configured to swing between an ON level and an OFF level. The emission driver is configured to switch the N-th emission control signal from the OFF level to the ON level at least twice during the duty driving period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate example embodiments of the invention and together with the description serve to explain the principles of the invention. In the drawings.

DETAILED DESCRIPTION OF EXAMPLE EMBODIMENTS

Reference will now be made in detail to the example embodiments of the present invention, which are illustrated in the accompanying drawings. The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 1:
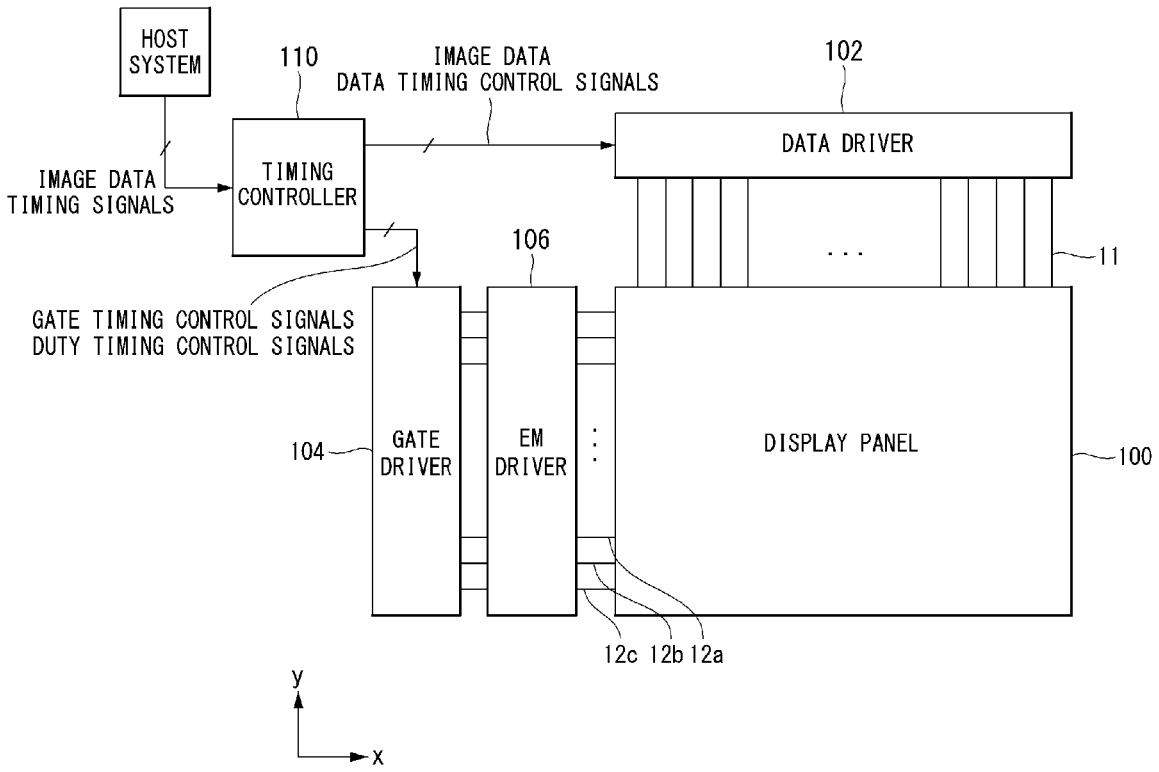
FIG. 1 is a block diagram illustrating an organic light emitting display according to an embodiment of the present disclosure.

FIG. 1 is a block diagram illustrating an organic light emitting display according to an embodiment of the present invention.

Figure 2:
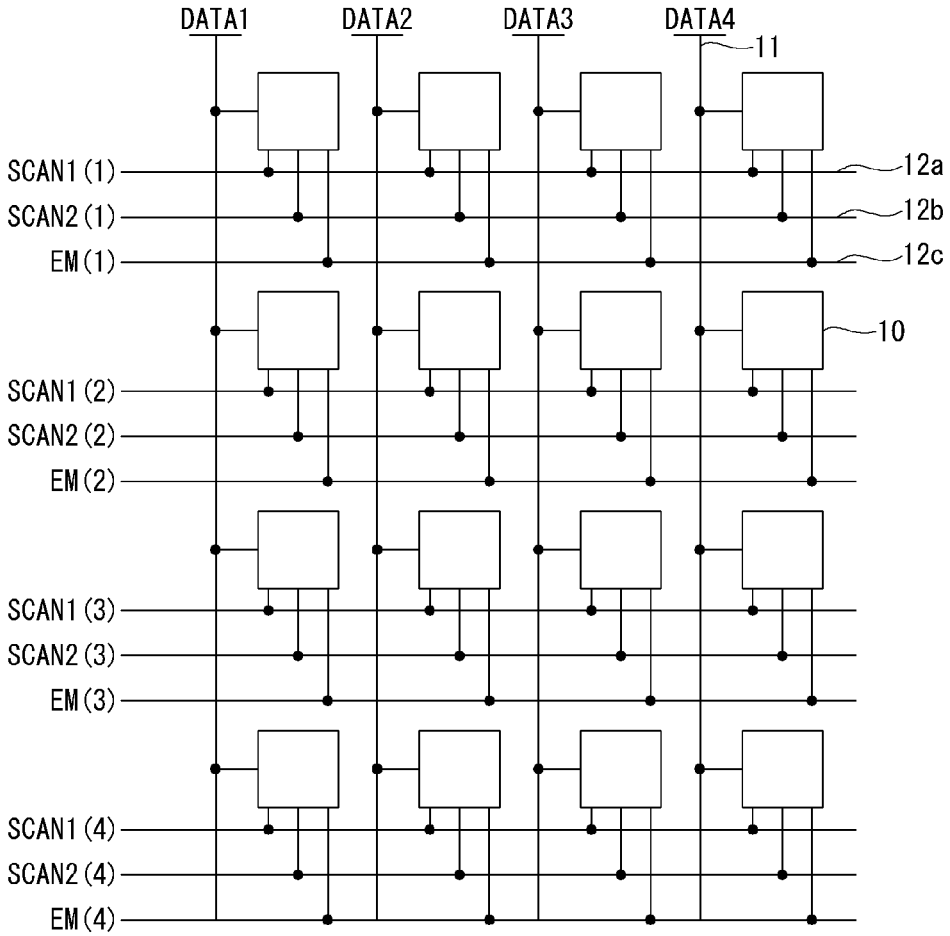
FIG. 2 is a schematic view of part of a pixel array.

As illustrated in FIGS. 1 and 2, the organic light emitting display according to an embodiment of the present invention includes a display panel 100, a data driver 102, a gate driver 104, an emission control (EM) driver 106, and a timing controller 110.

A plurality of data lines 11 and a plurality of gate lines 12*a*, 12*b*, and 12*c* cross one another on the display panel 100, and pixels 10 are arranged in a matrix form. An input image data is displayed on a pixel array of the display panel 100. The display panel 100 includes a reference voltage line (hereinafter referred to as a "REF line" and indicated with a reference numeral "16" in FIG. 3) connected to neighboring pixels 10, and a VDD line supplying a high-potential driving voltage VDD to the pixel 10. A predetermined initialization voltage (Vini in FIG. 3) may be supplied to the pixels 10 along the REF line.

Figure 3:
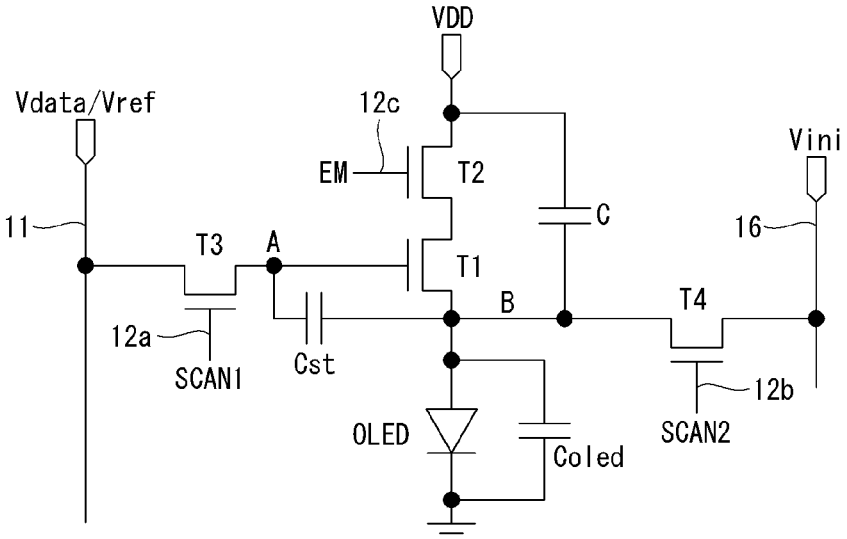
FIG. 3 is an equivalent circuit diagram illustrating an example of a pixel.
Figure 4:
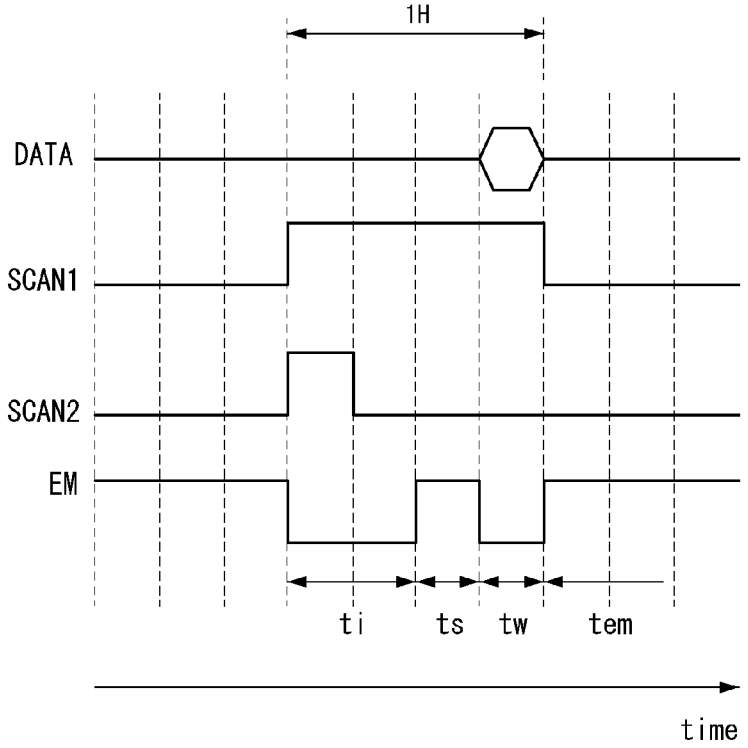
FIG. 4 is a waveform diagram illustrating signals input to the pixel shown in FIG. 3.

The gate lines 12*a*, 12*b*, and 12*c* include a plurality of first scan lines 12*a* to which a first scan pulse is supplied, a plurality of second scan lines 12*b* to which a second scan pulse is supplied, and a plurality of EM signal lines 12*c* to which an EM signal is supplied. In FIGS. 3 and 4, SCAN1 denotes the first scan pulse, SCAN2 denotes the second scan pulse, and EM denotes the EM signal.

To display colors, each of the pixels 10 may be divided into a red sub-pixel, a green sub-pixel, and a blue sub-pixel. Each of the pixels 10 may further include a white sub-pixel. To each of the pixels 10, a data line, a pair of gate lines, a REF line, and a VDD line, among others, are connected. The pair of gate lines includes a first scan line and a second scan line.

A 1-frame period of the organic light emitting display is divided into a scanning period and a duty driving period. The scanning period is a period of time in which data is addressed to pixels and then written to each of the pixels. The duty driving period is a period of time in which the pixels are turned on and off repetitively in accordance with an alternative-current EM signal after the scanning period. The scanning period may be a 1 horizontal period, and thus, the most part of 1 frame period constitutes the duty driving period. The pixels 10 are charged with a data voltage in the scanning period. In the duty driving period after the scanning period, instead of being additionally supplied with the data voltage, the pixels 10 are turned on and off repetitively in accordance with the alternative-current EM signal (EM) to display the input image data with the data voltage charged in the scanning period and with the same luminance for a 1-frame period.

The data driver 102 generates a data voltage by converting data DATA1 to DATA4 of an input image received from the timing controller 110 into a gamma compensation voltage under the control of the timing controller 110, and outputs the data voltage to the data lines 11. The data voltage is supplied to the pixels 10 along the data lines 11. To initialize driving devices of the pixels 10, the data driver 102 may output a predetermined reference voltage (Vref in FIG. 3) to the data lines 11 during an initialization period ti.

The gate driver 104 supplies an N-th scan pulse to an N-th scan line under the control of the timing controller 110, where N is a positive integer. The N-th scan pulse includes a pair of scan pulses SCAN1 and SCAN2, as shown in FIGS. 3 and 4. The pair of scan pulses SCAN1 and SCAN2 is supplied to N-th scan line. The N-th scan line includes scan lines 12*a* and 12*b*. The first scan pulse SCAN1 and the second scan pulse SCAN2 are synchronized with the data voltage. When the data voltage is supplied to the pixels, the first scan pulse SCAN1 remains in the ON level to turn on a switch device T3 so as to select pixels 10 to be charged with the data voltage. The second scan pulse SCAN2 rises simultaneously with the first scan pulse SCAN1, and falls before the first scan pulse SCAN1 to initialize the pixels 10 in the initialization period ti, as shown in FIG. 4. The second scan pulse SCAN2 is separated from a data writing timing. The second scan pulse SCAN2 is applied during the scanning period, in which data is written to the pixels 10, and then applied two or more times during the duty driving period to turn on the pixels 10.

Figure 8:
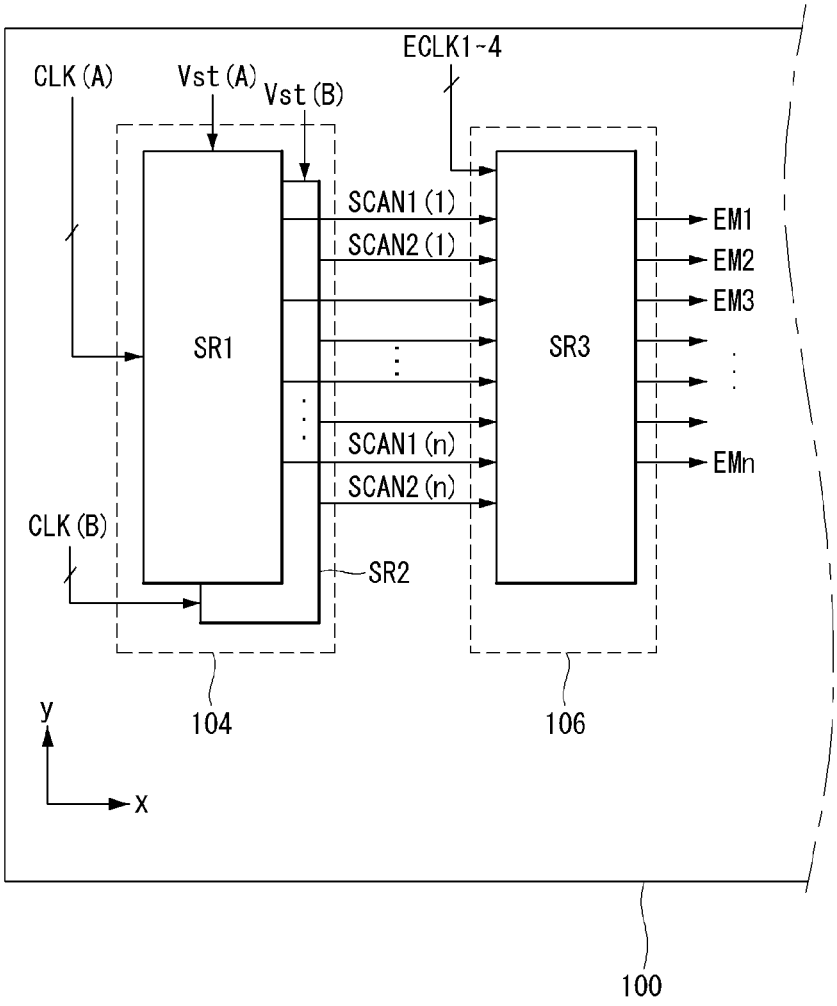
FIGS. 8 and 9 are diagrams illustrating an example in which a shift register of a gate driver and a shift register of an EM driver are implemented as GIP circuits.

The scan pulses SCAN1 and SCAN2 are input to the EM driver 106. The gate driver 104 shifts the scan pulses SCAN1 and SCAN2 using a shift resister to supply the scan pulses SCAN1 and SCAN2 to the scan lines 12*a* and 12*b* sequentially. As shown in FIG. 8, the shift register of the gate driver 104 may be formed directly on a substrate of the display panel 100 together with a pixel array in a Gate-driver In Panel (GIP) process.

Figure 5:
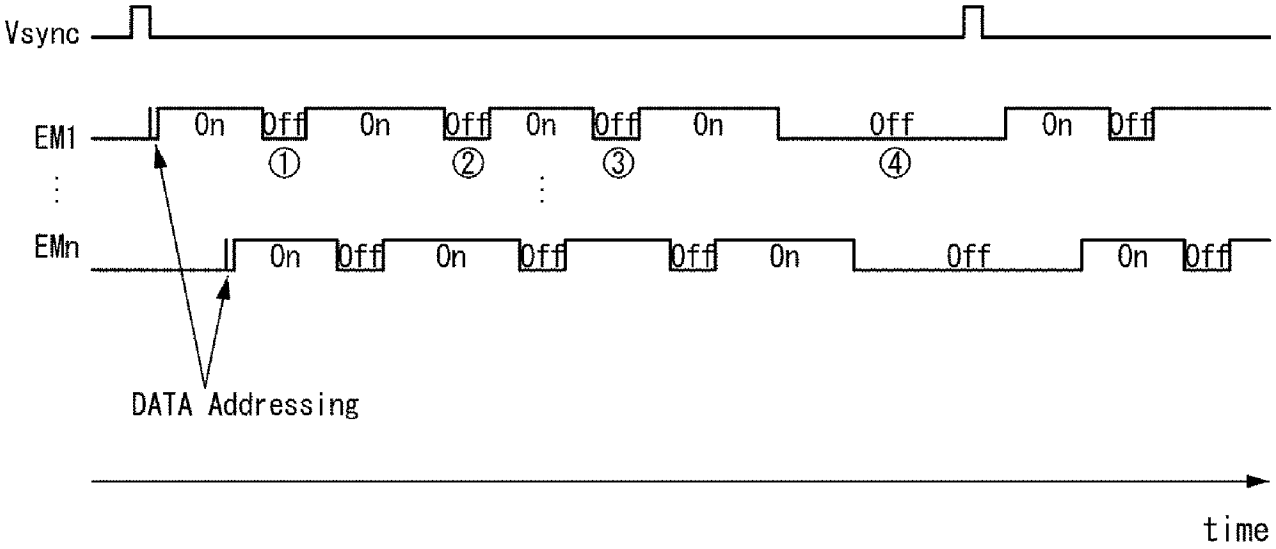
FIG. 5 is a waveform diagram illustrating a vertical sync signal and an emission control (EM) signal to explain a duty driving method according to an embodiment of the present invention.

The EM driver 106 supplies an N-th EM signal to the N-th EM signal line 12*c* under the control of the timing controller 110. The EM driver 106 is a duty driver which outputs an EM signal under the control of the timing controller 110 to supply the EM signal to the EM signal lines 12*c*. The EM driver 106 receives shift clocks ECLK1 to ECLK4, and also receives the scan pulses SCAN1 and SCAN2 respectively from the gate driver 104 to generate the EM signal using a shift register SR3 as show in FIG. 8. The EM driver 106 shifts the EM signal, as shown in FIG. 5, using a shift register to supply the EM signal to the EM signal lines 12*c* sequentially. As shown in FIG. 8, the shift register of the EM driver 106 may be formed directly on a substrate of the display panel 100 together with a pixel array in a GIP process.

Figure 11:
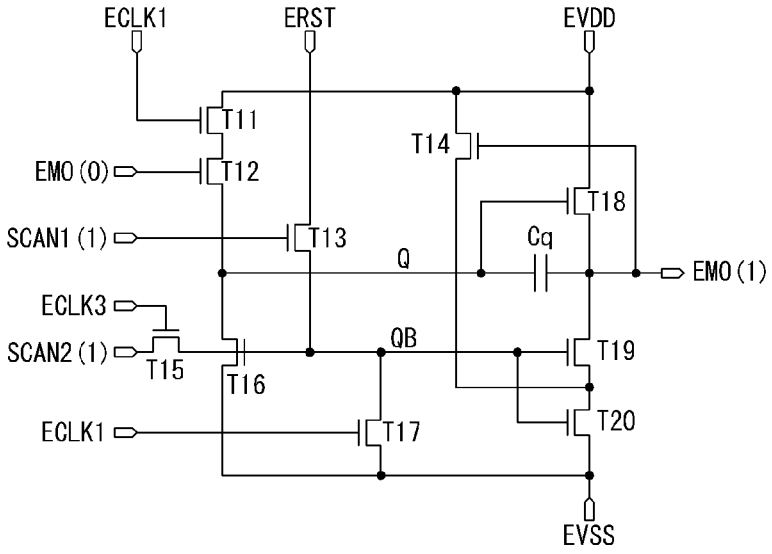
FIG. 11 is a circuit diagram illustrating an example circuit structure of the EM driver shown in FIG. 1.

The EM driver 106 may include a pull-up transistor (e.g., T18 in FIG. 11), one or more pull-down transistors (e.g., T19 and T20 in FIG. 11), a first switch element (e.g., T11 and T12 in FIG. 11), a second switch element (e.g., T13 in FIG. 11), and a third switch element (e.g., T15 in FIG. 11). The pull-up transistor charges an output node according to a voltage of a Q node (Q in FIG. 11) to output the EM signal (e.g., EMO(1) in FIG. 11) with the ON level. The pull-down transistors T19 and T20 discharge the output node according to a voltage of a QB node (QB in FIG. 11) to output the EM signal EMO(1) in the OFF level. The first switch device charges the Q node in response to a first shift clock (ECLK1 in FIG. 11) and an (N−1)-th EM signal (EMO(0) in FIG. 11). Here, N is a positive integer. The second switch element charges the QB node in response to a reset signal (ERST in FIG. 11) and the first scan pulse (SCAN1(1) in FIG. 11). The third switch element charges the QB node in response to the second scan pulse (SCAN2(1) in FIG. 11) and a second shift clock (ECLK3 in FIG. 11) during the duty driving period after the scanning period.

The timing controller 110 receives digital video data of an input image from a host system (not shown), and a timing signal synchronized with the digital video data. The timing signal may include a vertical sync signal Vsync, a horizontal sync signal Hsync, a clock signal CLK, and a data enable signal DE. The host system may be a TV system, a set-top box, a navigation system, a DVD player, a Blu-ray player, a personal computer (PC), a home theater system, a phone system, or any other system incorporating or used with a display.

The timing controller 110 generates a data timing control signal for controlling an operation timing of the data driver 102 based on a timing signal received from the host system, a gate timing control signal for controlling an operation timing of the gate driver 104, and a duty timing control signal for controlling an operation timing of the EM driver 106. The duty timing control signal is shown, for example, in FIG. 12. The timing controller 110 modulates a duty ratio of an EM signal in a PWM scheme so as to implement a duty driving method shown in FIGS. 5 and 6.

Each of the gate timing control signal and the duty timing control signal includes a start pulse and a shift clock. The respective start pulses cause a shift register of the gate driver 104 and a shift register of the EM driver 106 to generate their respective first output signals. A shift register starts to be driven in response to the start pulse, and outputs a first output signal at the first clock timing. A Gate Shift Clock (GSC) controls an output shift timing of the shift register.

FIG. 3 is an equivalent circuit diagram illustrating an example of a pixel. FIG. 4 is a waveform diagram illustrating signals input to the pixel shown in FIG. 3. The circuit diagram shown in FIG. 3 merely illustrates an example of a pixel, and the pixels of the present invention are not limited thereto.

As illustrated in FIGS. 3 and 4, for example, each pixel 10 may include an OLED, a plurality of Thin Film Transistors (TFTs) T1 to T4, and a storage capacitor Cst. A capacitor C may be connected between a second pixel TFT T2 and a second node B. In FIG. 3, Coled denotes a parasitic capacitance of the OLED.

The OLED is driven by an amount of current regulated by a first pixel TFT T1 according to a data voltage Vdata. A current path of the OLED may be switched by the second pixel TFT T2. The OLED includes an organic compound layer formed between an anode and a cathode of the OLED. The organic compound layer may include a hole injection layer (HIL), a hole transport layer (HTL), an emission layer (EML), an electron transport layer (ETL), and an electron injection layer EIL, but the present invention is not limited thereto. The anode of the OLED is connected to the second node B, and the cathode of the OLED is connected to a VSS line to which a base voltage VSS is applied.

The TFTs T1 to T4 are illustrated, for example, as n-type Metal Oxide Semiconductor Field Effect Transistors (MOSFETs) in FIG. 3, but they are not limited thereto. For example, the TFTs T1 to T4 may be implemented as p-type MOSFETs. In this alternative example, scan signals SCAN1 and SCAN2, and an EM signal EM are reversed in phase. The TFTs may be implemented as one of an amorphous silicon a-Si TFT, a polysilicon TFT, and an oxide semiconductor TFT, or as a combination thereof.

The anode of the OLED is connected to the first pixel TFT T1 via the second node B. The cathode of the OLED is connected to a base voltage source to be supplied with the base voltage VSS. The base voltage VSS may be a negative low-potential direct current voltage.

The first pixel TFT T1 is a driving device that regulates a current Ioled flowing through the OLED according to a gate-source voltage Vgs of the first pixel TFT T1. The first pixel TFT T1 includes a gate connected to a first node A, a drain connected to a source of the second pixel TFT T2, and a source connected to the second node B. The storage capacitor Cst is connected between the first node A and the second node B to maintain the gate-source voltage Vgs of the first pixel TFT T1.

The second pixel TFT T2 is a switch device that switches the current flowing through the OLED in response to an EM signal EM. The duty driving method is implemented in a manner of adjusting a turned-on period and a turned-off period of the OLED according to a duty ratio of the EM signal EM. A drain of the second pixel TFT T2 is connected to a VDD line to which a high-potential driving voltage VDD is supplied. The source of the second pixel TFT T2 is connected to the drain of the first pixel TFT T1. A gate of the second pixel TFT T2 is connected to an EM signal line 12*c* to be supplied with an EM signal EM. The EM signal EM is at the ON level during a sampling period is to turn on the second pixel TFT T2, and is reversed to the OFF level in an initialization period ti and a programming period tw to turn off the second pixel TFT T2. Then, the EM signal EM is applied as an alternative-current signal that swings between the ON level and the OFF level according to a PWM duty ratio in a light emission period tem to switch the current path of the OLED.

The third pixel TFT T3 is a switch device that supplies a reference voltage Vref or a data voltage Vdata to the first node A in response to a first scan pulse SCAN1. The third pixel TFT T3 includes a gate connected to a first scan line 12*a*, a drain connected to the data line 11, and a source connected to the first node A. The first scan pulse SCAN1 is supplied to the pixels 10 via the first scan line 12*a*. The first scan pulse SCAN1 is at the ON level for an approximately a 1-horizontal period 1H to turn on the third pixel TFT T3, and is reversed to the OFF level during the light emission period tem to turn off the third pixel TFT T3.

The fourth pixel TFT T4 is a switch device that supplies a predetermined initial voltage Vini to the second node B in response to the second scan pulse SCAN2. The fourth pixel TFT T4 includes a gate connected to the second scan line 12*b*, a drain connected to a REF line 16, and a source connected to the second node B. The second scan pulse SCAN2 is supplied to the pixels 10 along the second scan line 12*b*. The second scan pulse SCAN2 is at the ON level during the initialization period ti to turn on the fourth pixel TFT T4, and remains at the OFF level for the other periods to turn off the fourth pixel TFT T4.

The storage capacitor Cst is connected between the first node A and the second node B to store a voltage difference between the two nodes. The storage capacitor Cst may sample a threshold voltage Vth of the first pixel TFT T1, which is the driving device in this example, based on a source-follower method. The capacitor C is connected between the VDD line and the second node B. When the voltage of the first node A is changed from the reference voltage Vref to the data voltage Vdata in the programming period tw, the amount of this change in voltage at the first node A results in distribution of electric potential between capacitors Cst and C that is reflected at the second node B.

The scanning period for a pixel 10 may be divided into the initialization period ti, the sampling period ts, the programming period tw, and the light emission period tem. The scanning period ts is set approximately as a 1 horizontal period 1H, in which data is written to pixels arranged in one horizontal line in a pixel array. In the scanning period ts, a threshold voltage of the first pixel TFT T1, which is a driving device of the pixel 10, is sampled, and a data voltage is compensated as much as the threshold voltage. Therefore, in the 1 horizontal period 1H, data DATA of an input image is compensated as much as the threshold voltage of the driving device and then written to the pixel 10.

When the initialization period ti begins, the first and second scan pulses SCAN1 and SCAN2 rise to the ON level. At the same time, an EM signal EM falls to the OFF level. In the initialization period ti, the second pixel TFT T2 is turned off to block the current path of the OLED. The third and fourth pixel TFTs T3 and T4 turn on in the initialization period ti. In the initialization period ti, a predetermined reference voltage Vref is supplied to the data line 11. In the initialization period ti, a voltage of the first node A is initialized to the reference voltage Vref, while a voltage of the second node B is initialized to the predetermined initialization voltage Vini. After the initialization period ti, the second scan pulse SCAN2 is switched to the OFF level, thereby turning off the fourth pixel TFT T4. Here, the ON level indicates a gate voltage level that turns the switch devices T2 to T4 of the pixels on, and the OFF level indicates a gate voltage level that turns the switch devices T2 to T4 of the pixels off.

In the sampling period ts, the first scan pulse SCAN1 remains at the ON level, while the second scan pulse SCAN2 remains at the OFF level. The EM signal EM is switched to the ON level when the sampling period ts begins. In the sampling period ts, the second and the third pixel TFTs T2 and T3 turn on. In the sampling period ts, the second pixel TFT T2 turns on in response to the EM signal EM rising to the ON level. In the sampling period ts, the third pixel TFT T3 remains in an on state due to the first scan pulse SCAN1 remaining at the ON level. In the sampling period ts, the reference voltage Vref is supplied to the data line 11. In the sampling period ts, the potential at the first node A is maintained at the reference voltage Vref, while the potential at the second node B rises due to a drain-source current Ids. Based on this source-follower method, the gate-source voltage Vgs of the first pixel TFT T1 is sampled to be a threshold voltage of the first pixel TFT T1, and the sampled threshold voltage Vth is stored in the storage capacitor Cst. In the sampling period ts, a voltage of the first node A is the reference voltage Vref, and a voltage of the second node B is Vref−Vth.

In the programming period tw, the third pixel TFT T3 remains turned on due to the first scan pulse SCAN 1 remaining at the ON level. The other pixel TFTs T1, T2, and T4 are turned off. In the programming period tw, a data voltage Vdata of the input image is supplied to the data line 11. The data voltage Vdata is applied to the first node A. The amount of change in the voltage at the first node A, i.e., Vdata−Vref, causes distribution of electric potential between the capacitors Cst and C that is reflected at the second node B. As a result, the gate-source voltage Vgs of the first pixel TFT T1 is programmed. In the programming period tw, the voltage at the first node A is the data voltage Vdata, and the voltage at the second node B becomes (Vref−Vth)+C'*(Vdata−Vref). This is obtained by adding C'*(Vdata−Vref), which is the result of voltage distribution between the capacitors Cst and C, to Vref−Vth, which is set in the sampling period ts. As a result, in the programming period tw, the gate-source voltage Vgs of the first pixel TFT T1 is programmed to Vdata−(Vref+Vth)−C'*(Vdata−Vref). In this case, C' denotes Cst/(Cst+C).

When the light emission period tem begins, the EM signal EM rises to the ON level again, while the first scan pulse SCAN1 falls to the OFF level. In the light emission period tem, the second pixel TFT T2 remains turned on to form a current path through the OLED. In the light emission period tem, the first pixel TFT T1 regulates the amount of current flowing through the OLED based on a data voltage.

The light emission period tem begins after the programming period tw, and ends when an initialization period ti of a next frame begins. Instead of causing pixels to emit light constantly, the example embodiment of the present invention switches the EM signal EM based on a PWM duty ratio, which is modulated according to an input image data, so as to regulate a duty ratio of turning on and turning off the pixels. When the EM signal EM rises to the ON level, the second pixel TFT T2 turns on to form a current path through the OLED. In the light emission period tem, the OLED emits light since a current Ioled regulated according to the gate-source voltage Vgs of the first pixel TFT T1 flows in the OLED. In the light emission period tem, the first and second scan pulses SCAN1 and SCAN2 remain at the OFF level, so that the third and fourth pixel TFTs T3 and T4 are turned off.

The current Ioled flowing in the OLED in the light emission period tem is represented by Equation 1. The OLED emits light due to the current Ioled to display the brightness of the input image.

$$I_{oled} = \frac{k}{2}[(1 - C')(V_{data} - V_{ref})]^2 \quad \text{Equation (1)}$$

In Equation (1), k denotes a proportional constant that is determined by such factors as the mobility of the first pixel TFT T1, a parasitic capacitance, and a channel capacity.

Vth is eliminated from Ioled in Equation 1 since Vgs programmed in the programming period tw includes Vth. Therefore, a threshold voltage Vth of the driving device, i.e., the first pixel TFT T1 in this example, may not affect the current Ioled of the OLED.

Figure 6:
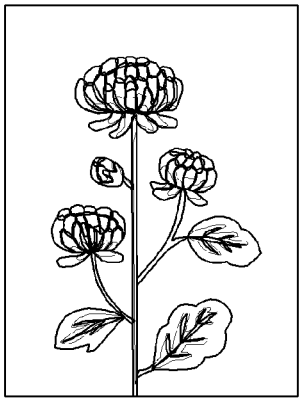
FIG. 6 is a diagram illustrating an example in which OFF sections are shifted during 1 frame period when an organic light emitting display is driven in a duty driving method.
Figure 6:
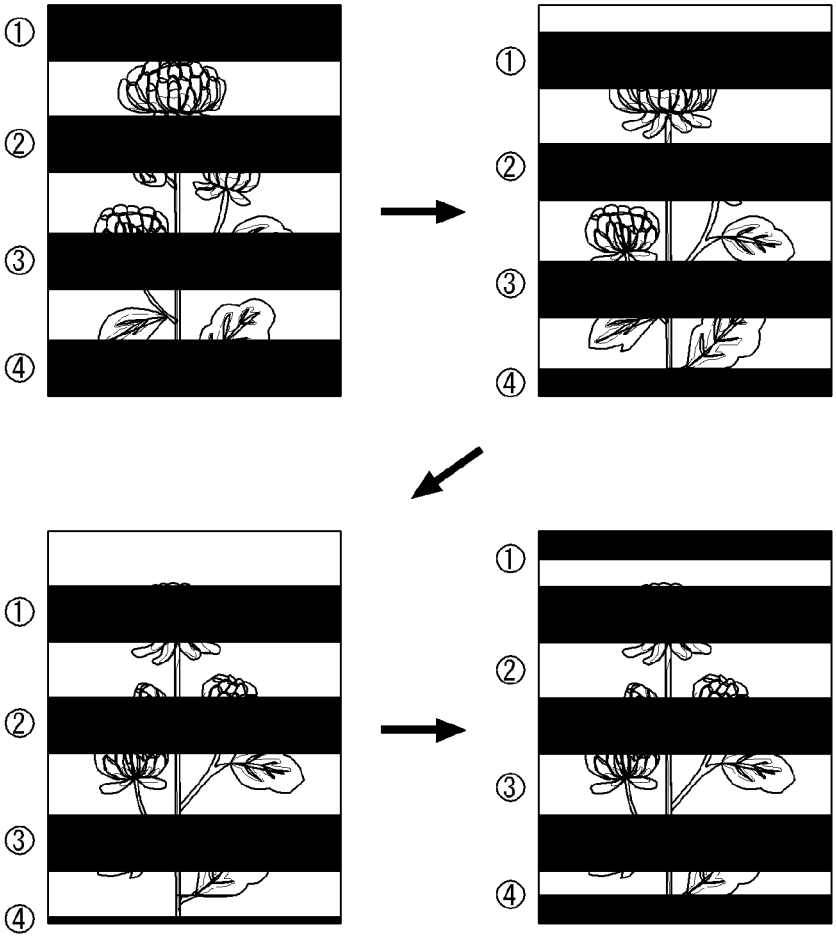

FIG. 5 is a waveform diagram illustrating a vertical sync signal and EM signals to explain a duty driving method according to an example embodiment of the present disclosure. FIG. 6 is a diagram illustrating an example in which OFF sections are shifted in a 1-frame period when an organic light emitting display is driven with a duty driving method. In FIG. 6, part (a) shows a full image of 1 frame, and part (b) shows an example of the OFF sections being shifted sequentially when the image of part (a) is displayed in the pixels with the duty driving method. As illustrated in FIGS. 5 and 6, the vertical sync signal Vsync is a timing signal that defines a 1-frame period. In the 1-frame period, an image data of 1 frame is addressed to be written to the pixels 10.

Figure 7:
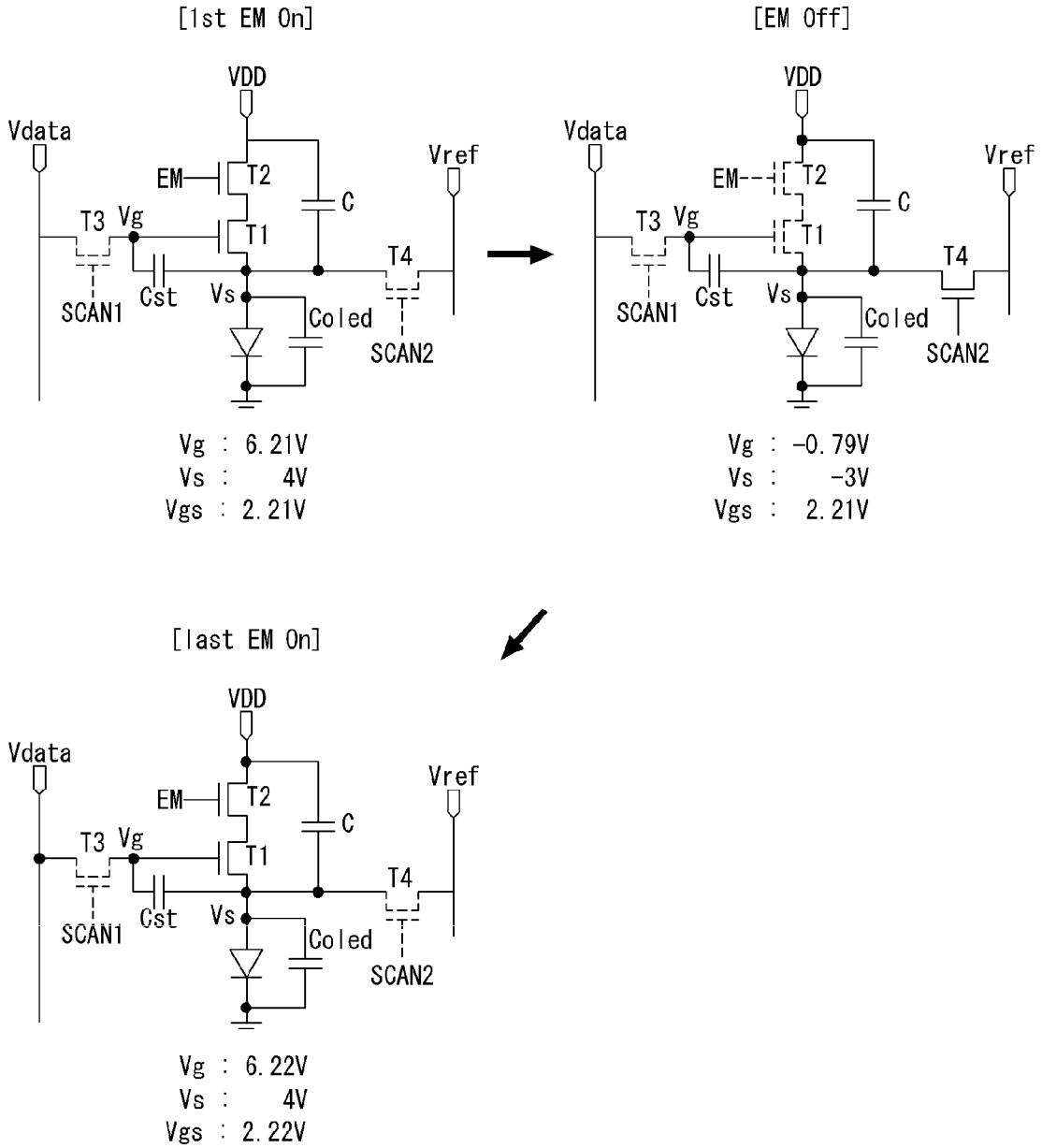
FIG. 7 is a diagram illustrating a principle of how data is maintained without additional data addressing within 1 frame period.

An input image data is addressed to the pixels only in an initial scanning period of 1 frame. The pixels are turned off in OFF-level sections of an EM signal EM during the duty driving period; however, as shown in FIG. 7, they maintain the previously-supplied data voltage. Thus, during the duty driving period after the scanning period, the pixels 10 are able to emit light with the same luminance in the turned-on sections between the turned-off sections of the pixels 10.

An ON-level section of an EM signal EM defines a light emitting section in a pixel array. The EM signal EM at the ON level forms a current path through the OLED in the pixels 10 to turn on the OLED. Meanwhile, an OFF-level section of an EM signal EM defines a non-light emitting section in a pixel array. In the OFF-level section, an EM signal at the OFF level is applied to the pixels 10. The pixels 10 in the OFF-level section display black contrast since the current path through the OLED is blocked and thus no current flows through the OLED.

The EM signal EM includes two or more cycles in a 1-frame period. A cycle of the EM signal EM includes one ON-level section and one OFF-level section. Accordingly, the ON-level sections of the EM signal EM are separated from one another by one or more intervening OFF-level sections in a 1-frame period. Due to the EM signal EM having such cycles, each of the pixels 10 is turned off at least once in the 1-frame period. As an OFF-level section of the EM signal EM is shifted, a non-light emitting section of the pixel array is shifted following the OFF-level section of the EM signal EM, as shown in FIG. 6.

The duty driving method may turn on the pixels 10 with an appropriately high data voltage Vdata within the 1-frame period, and adjust a duty ratio of an EM signal EM so as to adjust the luminance of the pixels 10 so that a response time of the pixels 10 may be reduced to mitigate a residual image. The duty driving method may increase the frequency of turning the pixels on and off within the 1-frame period so as to prevent a flicker that a user may recognize. In addition, when a data voltage to be applied to the pixels has been increased to increase the luminance of the pixels, the duty driving method may reduce a duty ratio of the pixels to display a low gray scale. In this manner, the duty driving method may prevent or reduce any irregularity that may occur with a low gray-scale data voltage. A low gray scale may be a gray scale of data whose most significant bits (MSB) may be "$0000_2$", and a high gray scale may be a gray scale of data whose MSB may be "$1111_2$".

In the example embodiment of the present invention, it is possible to maintain a data voltage of pixels without writing additional data to pixels in a duty driving period after a scanning period. Additional descriptions of the example embodiment are provided in conjunction with FIG. 7.

As shown in FIG. 7, after the data is addressed and written to the pixels during the scanning period, the first scan pulse SCAN1 falls to and remains at the OFF level in the remainder of a 1-frame period. As a result, after a data voltage is charged in the storage capacitor Cst, the first node A to which the gate of the first TFT T1 is connected is rendered floating. If a source voltage Vs of the first TFT T1 is changed, an electrical charge of the storage capacitor Cst is maintained constant, and a gate voltage Vg is changed according to the change in Vs. As a result, even though the data is not written to the pixels again after the pixels are turned off by the EM signal EM alternating between the ON-level section and the OFF-level section, a gate-source voltage Vgs of the first TFT T1, which is the driving device in this example, is maintained substantially constant. Since the gate-source voltage Vgs of the driving device T1 is maintained constant, the data written to the pixels 10 are maintained.

Figure 9:
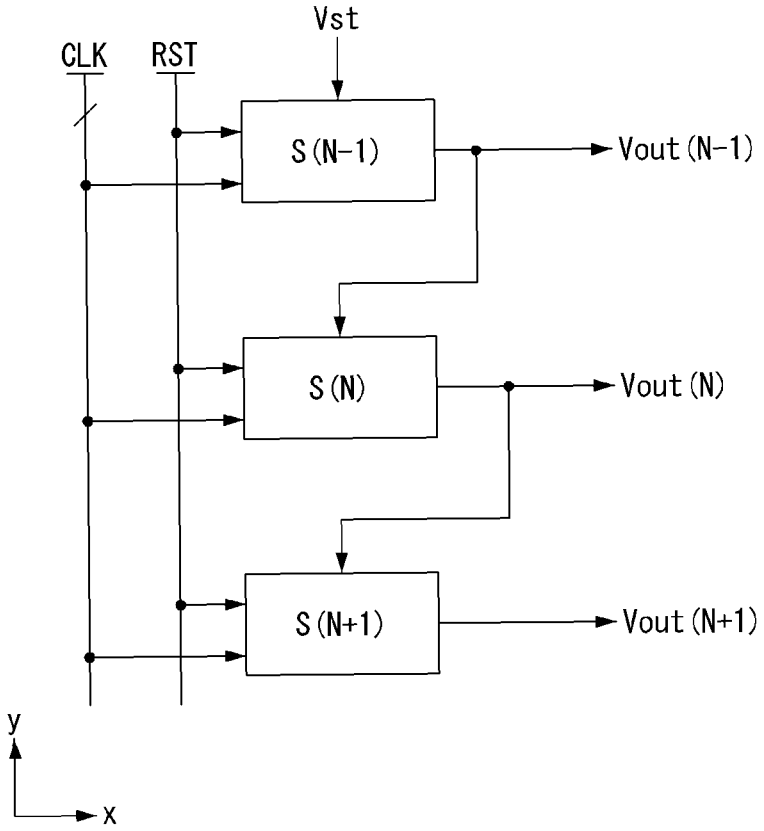
Figure 10:
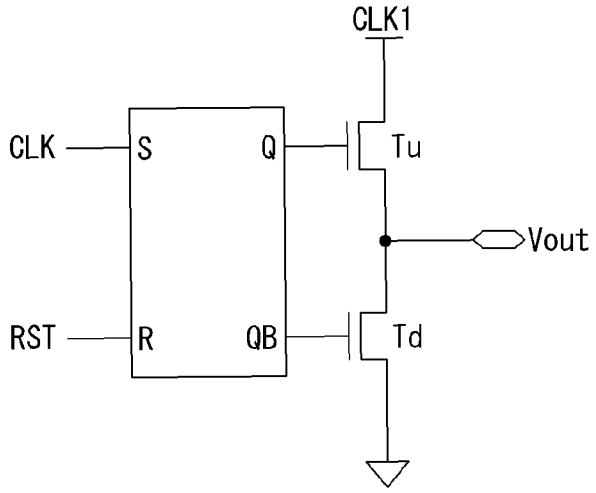
FIG. 10 is a schematic view illustrating an example structure of one stage in a GIP circuit.

FIGS. 8 and 9 are diagrams illustrating an example in which a shift register of the gate driver 104 and a shift register of the EM driver 106 are implemented as GIP circuits. FIG. 10 is a schematic view illustrating an example structure of one stage circuit in a GIP circuit. The circuit shown in FIG. 10 schematically shows an example of one stage in a shift register.

As shown in FIGS. 8 and 9, the gate driver 104 includes first and second GIP circuits directly formed on a substrate of the display panel 100. The first GIP circuit includes a first shift register SR1 to generate first scan pulses SCAN1(1) to SCAN1(*n*) sequentially, where n is a positive integer. The second GIP circuit includes a second shift register SR2 to generate second scan pulses SCAN2(1) to SCAN2(*n*) sequentially.

The EM driver 106 includes a third GIP circuit. The third GIP circuit includes a third shift register SR3 that receives shift clocks ECLK1 to ECLK4, and also receives the first and second scan pulses SCAN1 and SCAN2 respectively from the first and second shift registers SR1 and SR2 of the gate driver 104. According to a duty ratio, the third shift register SR3 shifts EM signals EM1 to EMn repetitively from the ON level to the OFF level, and vice versa, within one frame period.

Each of the shift registers SR1, SR2, and SR3 may include dependently connected stages S(N−1) to S(N+1), as shown in FIG. 9. As shown in FIG. 10, each of the stages S(N−1) to S(N+1) may include a Q node Q which controls a pull-up transistor Tu, a QB node QB which controls a pull-down transistor Td, and a switch circuit which controls the charging and the discharging the Q node Q and the QB node QB.

The timing controller 110 may generate gate timing control signals Vst(A), Vst(B), CLK(A), and CLK(B) to control operation timings of first and second GIP circuits GIP1 and GIP2. Vst(A) and Vst(B) are start pulses, and CLK(A) and CLK(B) are shift clocks. The first and second GIP circuits GIP1 and GIP2 are synchronized by the timing controller 110.

The timing controller 110 may generate shift clocks ECLK1 to ECLK4 to control a shift timing of the third shift register SR3, and a duty on timing and a duty off timing. In addition, the timing controller 110 may generate a reset signal RST to initialize the Q node Q of the shift registers SR1, SR2, and SR3. The timing controller 110 may also output timing control signals having a digital logic voltage level for controlling the gate driver 104 and the EM driver 106. The TFTs in a GIP circuit may be formed simultaneously with the TFTs in a pixel array, and may have a structure similar to that of the TFTs in the pixel array such that the TFTs in the GIP circuit are driven with a voltage higher than the digital logic voltage level. Therefore, the timing control signals Vst(A), Vst(B), CLK(A), CLK(B), and ECLK1 to ECLK4 output from the timing controller 110 may be changed by a level shifter (not shown) into a voltage that swings between a gate high voltage VGH and a gate low voltage VGL. The gate high voltage VGH is a voltage higher than a threshold voltage of the TFTs in the pixel array and the TFTs in the GIP circuit. The gate low voltage VGL is a voltage lower than the threshold voltage of the TFTs in the pixel array and the TFTs in the GIP circuit.

Figure 12:
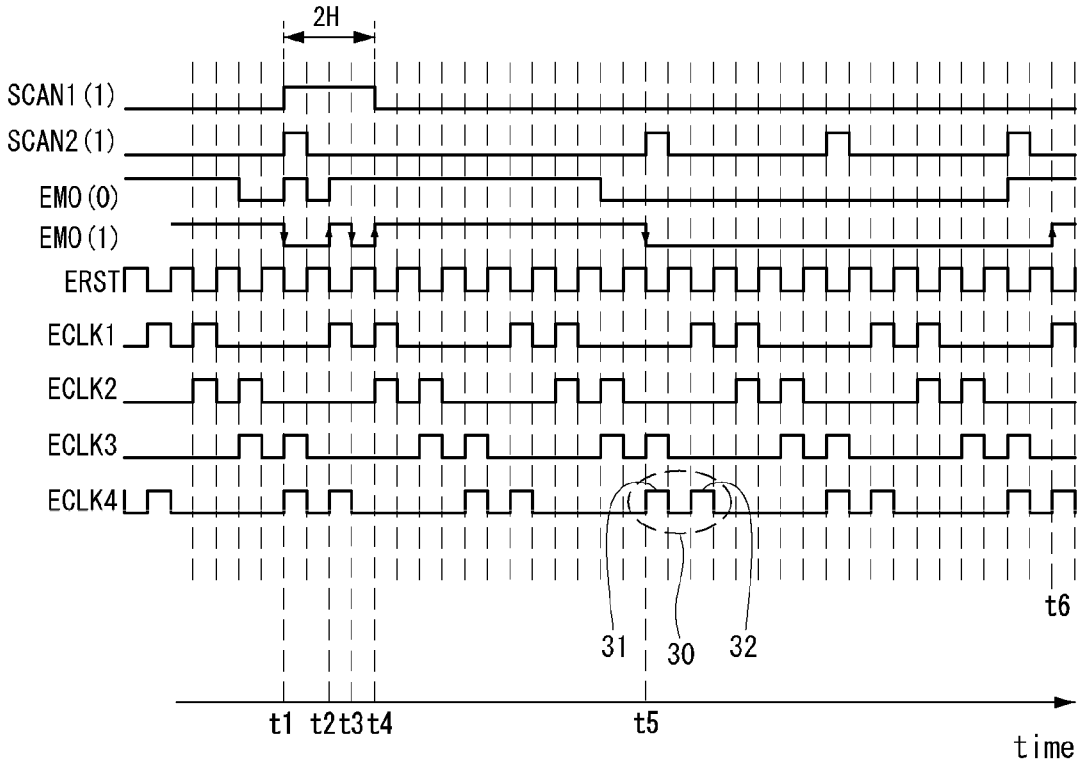
FIG. 12 is a waveform diagram illustrating example input and output signals in the circuit shown in FIG. 11.

FIG. 11 is a circuit diagram illustrating an example circuit structure of one stage of the EM driver 106 according to an example embodiment of the present invention. FIG. 12 is an example waveform diagram illustrating the input and output signals in the example circuit shown in FIG. 11.

As shown in FIGS. 11 and 12, the EM driver 106 may include: a Q node which controls the pull-up transistor T18, a QB node which controls the pull-down transistor T19 and T20, and a plurality of switch devices T11 to T20. The switch devices T11 to T20 may be implemented as n-type MOSFETs, but this example embodiment is not limited thereto.

The first and second scan pulses SCAN1(1) and SCAN2(1), a previous EM signal EMO(0), and shift clocks ECLK1 and ECLK3 may be input to the EM driver 106.

Each of the first and second scan pulses SCAN1(1) and SCAN2(1) are substantially identical to the scan pulses SCAN1 and SCAN2 shown in FIG. 4. The first and second scan pulses SCAN1(1) and SCAN2(1) rise simultaneously. A pulse width of the first scan pulse SCAN1(1) is greater than that of the second scan pulse SCAN2(1). When the pulse width of the first scan pulse SCAN1(1) is 1 horizontal period 1H, for example, the pulse width of the first scan pulse may be a ¼ horizontal period. However, this example embodiment is not limited thereto.

If the stage shown in FIG. 11 is the N-th stage that outputs the N-th EM signal (N is a positive integer), the previous EM signal EMO(0) is the (N−1)-th EM signal output from the (N−1)-th stage. In the example illustrated in FIG. 11, N is 1. At the beginning of the scanning period for this stage, the EM signal EMO(1) may fall while the first and second scan pulses SCAN1(1) and SCAN2(1) rise. At the end of the scanning period, the EM signal EMO(1) may rise while the first scan pulse SCAN1(1) falls.

In order to implement a duty driving method, each of the EM signals EMO(0) and EMO(1) may include at least one OFF-level section after the scanning period during in a 1-frame period. To control the EM signal EMO(0) or EMO(1) to be at the OFF level in order to implement the duty driving method, a timing signal independent of the data writing is used. If the OFF-level section of the EM signal EMO(0) or EMO(1) is controlled after a scanning period by using a timing signal for writing data of an input image to pixels, the data to be written to the pixels may be changed from the intended data. The example embodiment of the present invention allows for controlling the timing of the OFF-level section or sections of the EM signal EMO(1) by using the second scan pulse SCAN2(1) and a shift clock, which are not used for the data writing. Thus, it is possible to prevent an unintended change of data to be written to the pixels and to control the OFF-level section or sections to be as long as desired.

The shift clocks ECLK1 to ECLK4 may be provided as four-phase clocks whose phases are delayed sequentially. The shift clocks ECLK1 to ECLK4 may occur as a pair of clock pulses 30. The pair of clock pulses 30 includes first and second pulses 31 and 32 which are provided consecutively in a 2-horizontal period 2H. In each of the shift clocks ECLK1 to ECLK4, an interval between the pair of the clocks 30 is equal to or greater than a 1-horizontal period 1H. The N-th shift clock ECLK1 and the (N+2)-th shift clock ECLK3 are non-overlapping shift clocks (N is a positive integer). The first pulse 31 of the (N+1)-th shift clock ECLK2 overlaps the second pulse 32 of the N-th clock ECLK1, and the second pulse 32 of the (N+1)-th shift clock ECLK2 overlaps the first clock 31 of the (N+2)-th clock ECLK3.

Clock pulses of the reset signal ERST are provided continuously at a predetermined interval. The clock pulses of the reset signal ERST may be provided at the same interval as the shift clocks ECLK1 to ECLK4.

When the EM driver 106 is implemented as a GIP circuit, EVDD having a VGH potential may be provided, and EVSS having a VGL potential may be provided. In addition, the scan pulses SCAN1(1) and SCAN2(1), the shift clocks ECLK1 to ECLK4, and clock pulses of the reset signal ERST may be provided with a voltage that swings between VGH and VGL.

Hereinafter, an example circuit structure and operations of the EM driver 16 will be described for an example in which the circuit shown in FIG. 11 is the N-th stage, which outputs the N-th EM signal EMO(1). In other words, N is a positive integer, and the below example describes an example stage where N is 1.

The first and second TFTs T11 and T12 charge the Q node Q with a high-potential driving voltage EVDD when the (N−1)-th EM signal EMO(0) is at the ON level and the first shift clock ECLK1 is at the ON level. The first TFT T11 is a switch device that turns on in response to the first shift clock pulse ECLK1. A gate of the first TT T11 is connected to an ECLK line to which the first shift clock ECLK1 is input. A drain of the first TFT T11 is connected to an EVDD line to which the high-potential driving voltage EVDD is supplied. A source of the first TFT T11 is connected to a drain of the second TFT T12. The second TFT T12 turns on in response to the (N−1)-th EM signal EMO(0) being at ON level or in response to a start pulse (not shown). A gate of the second TFT T12 is connected to a start terminal to which the (N−1)-th EM signal EMO(0) or a start pulse is input. A source of the second TFT T12 is connected to the Q node Q. The drain of the second TFT T12 is connected to the source of the first TFT T11.

The third TFT T13 charges the QB node QB with a reset signal ERST in response to the first scan pulse SCAN1(1). The first scan pulse SCAN1(1) is input to a gate of the third TFT T13. The reset signal ERST is input to a drain of the third TFT T13. A source of the third TFT T13 is connected to the QB node QB.

The fourth TFT T14 charges a node between the ninth and tenth TFTs T19 and T20 with a high-potential driving voltage EVDD when the N-th EM signal EMO(1) is output at the ON level. Accordingly, the fourth TFT T14 controls a gate-source voltage of the ninth TFT T19 to be lower than a threshold voltage thereof to prevent a leakage current. When the N-th EM signal EMO(1) is output at the ON level, a discharge path through the pull-down transistor T19 and T20 is blocked. A gate of the fourth TFT T14 is connected to an output node. A drain of the fourth TFT T14 is connected to the EVDD line. A source of the TFT T14 is connected to a node between a source of the ninth TFT T19 and a drain of the tenth TFT T20.

The fifth TFT T15 charges the QB node QB with a voltage of the second scan pulse SCAN2(1) in response to the third shift clock ECLK3. A gate of the fifth TFT T15 is connected to an ECLK3 line to which the third shift clock ECLK3 is input. The second scan pulse SCAN2(1) is input to a drain of the fifth TFT T15. A source of the fifth TFT T15 is connected to the QB node.

When a voltage of the QB node is at the ON level, the sixth TFT T16 turns on to discharge the Q node Q. A gate of the sixth TFT T16 is connected to the QB node. A drain of the sixth TFT T16 is connected to the Q node Q. A source of the sixth TFT T16 is connected to the EVSS line. A base voltage EVSS or a gate low voltage VGL is supplied to the EVSS line.

In response to the first shift clock ECLK1, the seventh TFT T17 forms a discharge path for a voltage of the QB node QB. A gate of the seventh TFT T17 is connected to the ECLK1 line. A drain of the seventh TFT T18 is connected to the QB node QB. A source of the seventh TFT T17 is connected to the EVSS line.

The eighth TFT T18 is a pull-up transistor that charges the output node with a voltage of the Q node Q, thereby causing the N-th EM signal to rise. A gate of the eighth TFT T18 is connected to the Q node Q. A drain of the eighth TFT T18 is connected to the EVDD line. A source of the eighth TFT T18 is connected to the output node. A capacitor Cq may be connected between the gate and the source of the eighth TFT T18. The capacitor Cq stores a gate-source voltage Vgs of the eighth TFT T18.

The ninth and the tenth TFTs T19 and T20 constitute a pull-down transistor which is connected to the QB node QB in a dual-gate structure. When the voltage of the QB node QB is at the ON level, the ninth and the tenth TFT T19 and T20 turn on to form a discharge path of the output node, thereby causing the N-th EM signal EMO(1) to fall. A switch device in a dual-gate structure increases resistance and thus it is effective in reducing a leakage current. A gate of the ninth TFT T19 is connected to the QB node QB. A drain of the ninth TFT T19 is connected to the output node. A source of the ninth TFT T19 is connected to a drain of the tenth TFT T20. A gate of the tenth TFT T20 is connected to the QB node QB. The drain of the tenth TFT T20 is connected to the source of the ninth TFT T19. A source of the tenth TFT T20 is connected to the EVSS line.

Hereinafter, an example method for controlling the N-th EM signal EMO(1) will be described in detail. In FIG. 12, t1 to t4 correspond to particular times within a scanning period, during which an input image data is written to pixels. The N-th EM signal EMO(1) provided during the scanning period at t1 to t4 is substantially the same as the EM signal shown in FIG. 4.

The second scan pulse SCAN2(1) and the second pulse 32 of the third shift clock ECLK3 rise at t1 to the ON level and remain at the ON level until t2. At this point, the fifth TFT T15 turns on to charge the QB node QB, and the pull down transistors T19 and T20 turn on in response to the ON-level voltage of the QB node QB to form a discharge path of the output node. As a result, the N-th EM signal EMO(1) falls at t1 to the OFF level and remains at the OFF level until t2.

The first pulse 31 of the first shift clock ECLK1 and the (N−1)-th EM signal EMO(0) rise at t2 to remain high until t3. At this point, the first and the second TFTs T11 and T12 turn on to charge the Q node with the high-potential driving voltage EVDD, and the pull-up transistor T18 turns on in response to the ON-level voltage of the Q node to charge the output node. As a result, the N-th EM signal EMO(1) rises at t2 to the ON level and remains at the ON level until t3.

When the reset signal ERST and the first scan pulse SCAN1(1) are at the ON level, e.g., between t3 and t4, the N-th EM signal EMO(1) is at the OFF level. At t3, the third TFT T13 turns on to charge the QB node QB with a voltage of the reset signal ERST, and the pull-down transistors T19 and T20 turn on to form a discharge path of the output node. As a result, the N-th EM signal EMO(1) falls at t3 to the OFF level and remains at the OFF level until t4.

A period following t4 is a duty driving period for controlling a duty ratio of the N-th EM signal EMO(1) without additionally writing data to the pixels. In the duty driving period, the ON-level sections of the N-th EM signal EMO(1) are controlled by the first shift clock ECLK1 and the (N−1)-th EM signal EM0(0).

In the example embodiment of present invention, the scan pulse SCAN2 is additionally provided, unrelated to writing data to the pixels, in the duty driving period after the scanning period. Accordingly, the respective duty ratios of the pixels can be controlled in the duty driving period without the problems associated with using a timing signal related to the writing of data to the pixels.

If the second scan pulse SCAN2 swings from high to low, or vice versa, during the duty driving period, the fourth TFT T4 (FIGS. 3 an 7) connected to the pixels 10 (FIG. 2) are switched from the ON level to the OFF level, or vice versa. As a result, as shown in FIGS. 3 and 7, a voltage of the second node B, that is, a source voltage Vs of the driving device T1, may be changed. Even though the source voltage Vs is changed, the gate of the driving device T1 remains floating, as shown in FIG. 7. Therefore, even in the case where a gate voltage is changed to follow the source voltage Vs and the pixels are turned on and off repetitively, the gate-source voltage Vgs of the driving device T1 may be maintained substantially constant.

In the duty driving period, the OFF-level sections of the N-th EM signal EMO(1) are controlled by the second scan pulse SCAN2(1) and the third shift clock ECLK3. As shown in FIG. 11, when the second scan pulse SCAN2(1) and the third shift clock ECLK3 are at the ON level, the N-th EM signal EMO(1) is provided at the OFF level. In the duty driving period, this additionally provided second scan pulse SCAN2(1) may be synchronized with the second pulse 32 of the third shift clock ECLK3 (see, e.g., FIG. 12). At this point, e.g., at t5 in FIG. 12, the fifth TFT T15 turns on to charge the QB node QB with a voltage of the second scan pulse SCAN2(1), and the pull-down transistors T19 and T20 turn on to form a discharge path of the output node, as shown in FIG. 11. As a result, the N-th EM signal EMO(1) falls to the OFF level at t5.

The example embodiment of the present invention controls the number of OFF-level sections of the N-th EM signal EMO(1) in the duty driving period based on the output timing of the second scan pulse SCAN2(1). In addition, the example embodiment of the present invention may periodically generate the second scan pulses SCAN(1) to prevent the output node from floating for a long period of time in an OFF-level section of the N-th EM signal EM0(1).

If the ON-level sections of the N-th EM signal EMO(1) are controlled only based on the first shift clock ECLK1 in the duty driving period, the N-th EM signal EMO(1) may be changed to the ON level when the first shift clock ECLK1 is input in an OFF-level section of the N-th EM signal EM0(1). In view of this potential drawback, the example embodiment of the present invention may provide the N-th EM signal EMO(1) at the ON level only when the first shift clock ECLK1 is provided during an ON-level section of the (N−1)-th EM signal EMO(0).

Because the data that is written to the pixels 10 may be changed if the EM signals are output based on the scan pulses synchronized with the data, it may be impossible or difficult to implement a display device with a duty driving method by using such scan pulses to control the output EM signals. To mitigate this problem, the example embodiments of the present invention may incorporate the EM driver 108, which is provided separately from the gate driver 104, to generate an EM signal capable of being controlled with a duty driving method.

Figure 13:
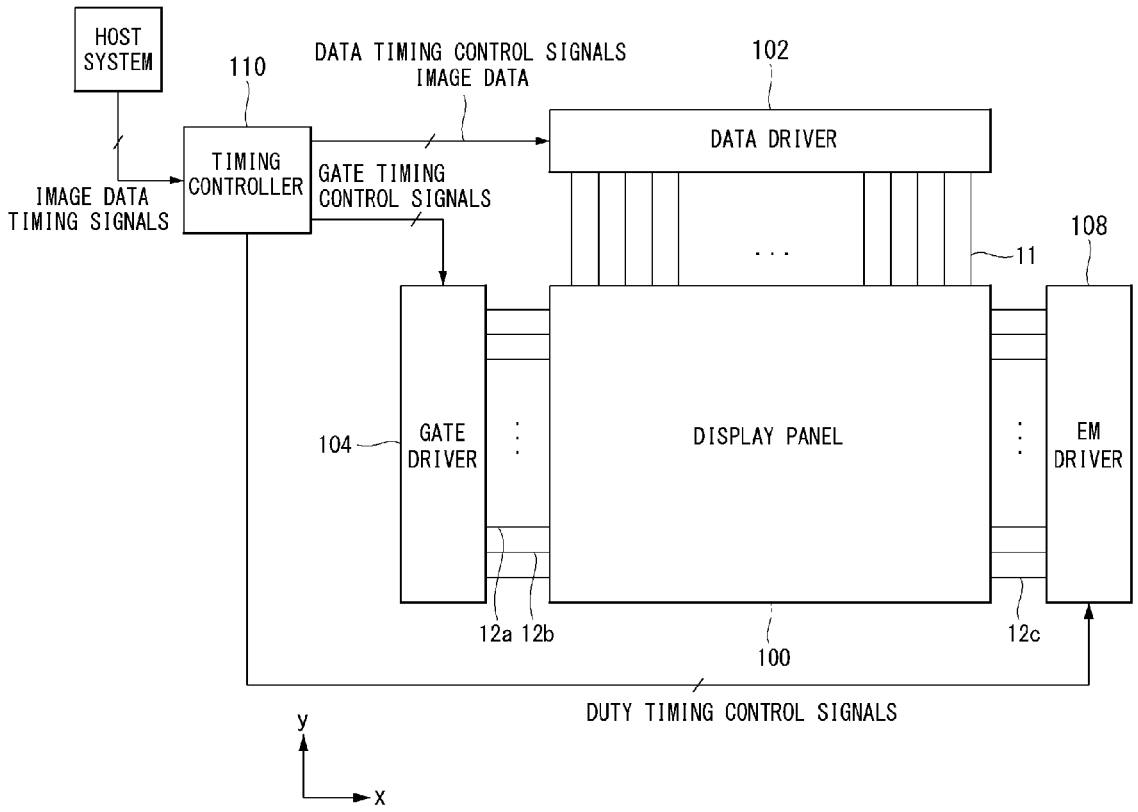
FIG. 13 is a block diagram illustrating an organic light emitting display according to another embodiment of the present disclosure.

FIG. 13 is a block diagram illustrating an organic light emitting display according to another example embodiment of the present invention. As shown in FIG. 13, an organic light emitting display includes a display panel 100, a data driver 102, a gate driver 104, an EM driver 108, and a timing controller 110. The display panel 100, the data driver 102, and the gate driver 104 shown in the example embodiment of FIG. 13 are substantially identical to those shown in the aforementioned example embodiment. Thus, detailed descriptions of these elements are not repeated.

The gate driver 104 supplies an N-th data-writing scan pulse to an N-th scan line under the control of the timing controller 110. The N-th data-writing scan pulse includes a pair of data-writing scan pulses SCAN1 and SCAN2. The N-th scan line includes scan lines 12*a* and 12*b*. The gate driver 104 generates the first and second data-writing scan pulses SCAN1 and SCAN2 sequentially through respective scan lines 12*a* and 12*b*. The first and second data-writing scan pulses SCAN1 and SCAN2 are provided for writing data to the pixels only in a scanning period, not in a duty driving period which follows the scanning period.

The EM driver 108 supplies an N-th EM signal to the N-th EM signal line 12*c* under the control of the timing controller 110. The EM driver 108 outputs an EM signal EM under the control of the timing controller 110, and supplies the EM signals to EM signal lines 12*c*. The EM driver 108 does not receive an output of the gate driver 104. If the EM driver 108 is provided separate from the gate driver 104, it is possible to prevent the data written to pixels from being changed when the EM driver 108 generates an EM signal EM in response to a scan pulse output from the gate driver 104. The EM driver 108 may be implemented as the example circuit shown in FIG. 14.

As shown in FIG. 8, the EM driver 108 may be formed directly on a substrate of the display panel 100, and may be formed together with the gate driver 104 and a pixel array in a GIP process. However, unlike the example circuit shown in FIG. 8, the EM driver 108 of this this example embodiment does not receive scan pulses from the gate driver 104.

The timing controller 110 generates a data timing control signal for controlling an operation timing of the data driver 102 based on a timing signal received from a host system (not shown), a gate timing signal for controlling an operation timing of the gate driver 104, and a duty timing control signal for controlling an operation of the EM driver 108. The duty timing control signal may comprise some of the signals shown in FIG. 15. The timing controller 110 modulates a duty ratio of an EM signal in a PWM scheme to implement the duty driving method shown, for example, in FIGS. 5 and 6.

Figure 14:
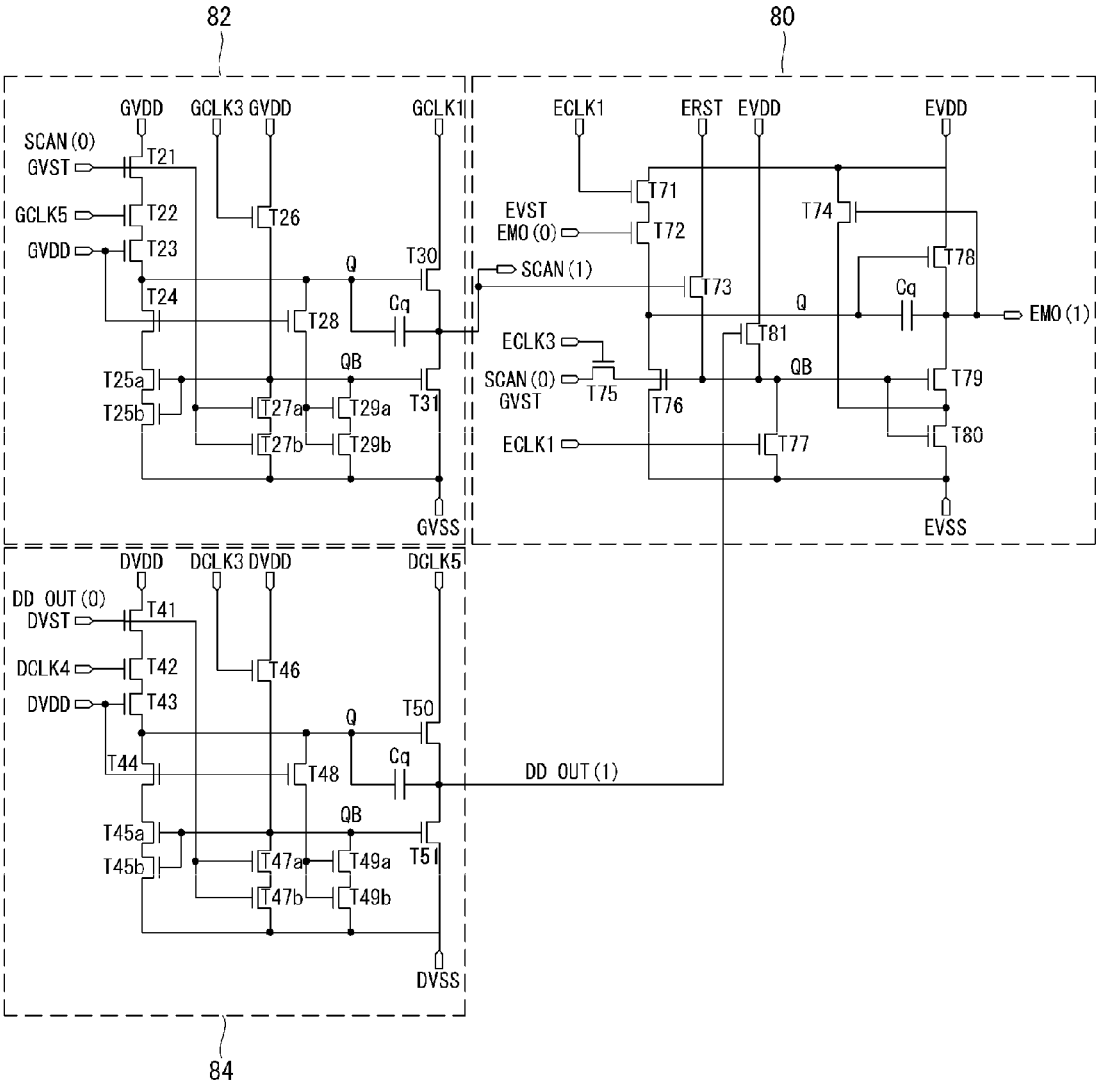
FIG. 14 is a circuit diagram illustrating an example circuit structure of the EM driver shown in FIG. 13.
Figure 15:
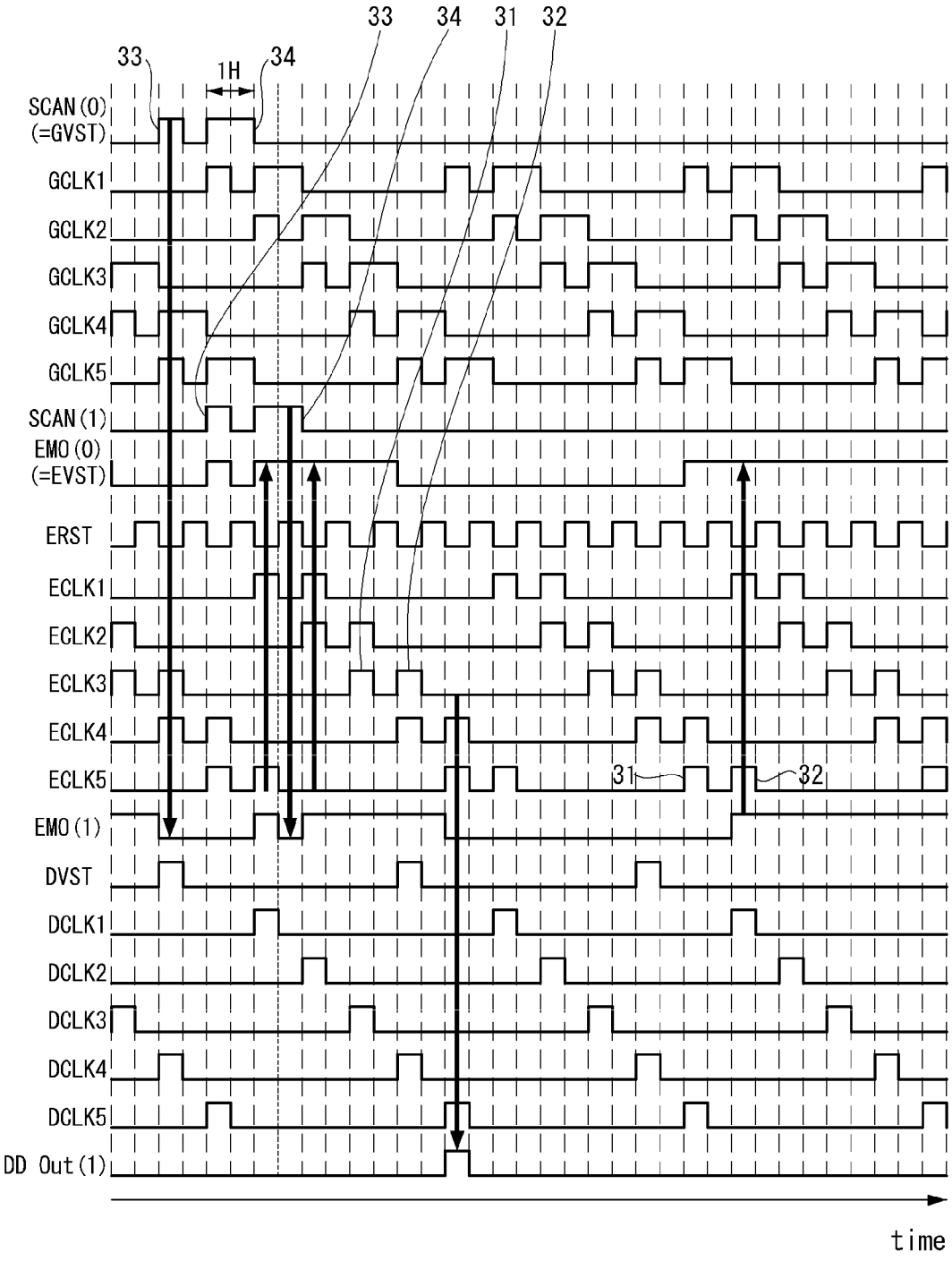
FIG. 15 is a waveform diagram illustrating example input and output signals in the example circuit shown in FIG. 14.

FIG. 14 is a circuit diagram illustrating an example circuit structure of the EM driver shown in FIG. 13. The circuit shown in FIG. 14 shows an example of one stage circuit, out of n stages (n being a positive integer), in each of the shift registers 80, 82, and 84. FIG. 15 is an example waveform diagram illustrating input and output signals in the example circuit shown in FIG. 14.

As shown in FIGS. 14 and 15, the EM driver 108 may include an input signal generating circuit, a pull-up transistor T78, one or more pull-down transistors T79 and T80, a first switch element T71 and T72, a second switch device T73, a third switch device T75, and a fourth switch device T81. The input signal generating circuit includes the first and second shift registers 82 and 84. The input signal generating circuit may generate the (N−1)-th scan pulse SCAN(0) and the N-th scan pulse SCAN(1), which are independent of the first and second data-writing scan pulses SCAN1 and SCAN2, and generate a duty signal DD OUT at least twice in a duty driving period after a scanning period. The pull-up transistor T78 charges an output node according to a voltage of the Q node to output the N-th EM signal EMO(1) at the ON level. The pull-down transistors T79 and T80 discharge the output node according to a voltage of the QB node to output the N-th EM signal EMO(1) at the OFF level. The first switch element T71, T72 charges the Q node in response to the first shift clock ECLK1 and the (N−1)-th EM signal EM0(0). The second switch device T73 charges the QB node in response to a reset signal ERST and the N-th scan pulse SCAN(1). The third switch device T75 charges the QB node in response to the second shift clock (ECLK3 in FIG. 14) and the (N−1)-th scan pulse SCAN(0). In response to a duty signal DD OUT, the fourth switch device charges the QB node only in the duty driving period. As shown in FIG. 15, each of the (N−1)-th scan pulse SCAN(0) and the N-th scan pulse SCAN(1) may be provided as a pair of clock pulses including a first pulse 33 and a second pulse 34 having a width greater than that of the first pulse 33. Each of the first shift clock ECLK1 and the second shift clock ECLK3 may be provided as a pair of clock pulses including the first and second pulses 31 and 32. The pair of clock pulses of the first shift clock ECLK1 does not overlap the pair of clock pulses of the second shift clock ECLK3.

The first shift register 82 which outputs the (N−1)-th and the N-th scan pulses SCAN(0) and SCAN(1) sequentially, a second shift register 84 which outputs an N-th duty signal DD OUT(1), and a third shift register 80 which receives the outputs of the first and the second shift registers 82 and 84 to output the N-th EM signal EMO(1). N is a positive integer between 1 and n. For ease of reference, N is 1 for the example one stage shown in FIG. 14.

The first shift register 82 outputs the N-th scan pulse SCAN(1), which is unrelated to writing an input image data to the pixels, and shifts the scan pulse SCAN(1) at every shift clock timing GCLK1 to GCLK5. The scan pulse SCAN(1) controls OFF-level sections of the N-th EM signal EMO(1) in the scanning period. The second shift register 84 outputs the duty signal DD OUT(1), and shifts the duty signal DD OUT(1) at every shift clock timing DCLK1 to DCLK5. The duty signal DD OUT (1) controls OFF-level sections of the N-th EM signal EMO(1) in the duty driving period. The third shift register 80 outputs the N-th EM signal EMO(1) using the scan signal SCAN(1) and the duty signal DD OUT(1), and shifts the N-th EM signal EMO(1) at every shift clock timing ECLK1 to ECLK5.

Each of the shift registers 80, 82, and 84 includes: a Q node which controls a pull-up transistor (e.g., T30, T50, or T78), a QB node QB which controls one or more pull-down transistors (e.g., T31, T51, or T79 and T80), and a plurality of switch devices (e.g., T21-T29*b*, T41-T49*b*, or T71-T77). The switch devices may be implemented as n-type MOSFETs, but the example embodiment is not limited thereto.

If the shift registers 80, 82, and 84 are implemented as GIP circuits, GVDD, DVDD, and EVDD having a VGH potential are provided in FIG. 14. In addition, GVSS, DVSS, and EVSS having a VGL potential may be provided. The signals shown in FIG. 15, such as SCAN(0), SCAN(1), GVST, DVST, GCLK1 to GCLK5, ERST, ECLK1 to ECLK5, DCLK1 to DCLK5, EVST, EMO(0), and EMO(1), may be provided to have a voltage that swings between VGH and VGL. GVST, DVST, and EVST are start pulses.

The start pulse GVST, the shift clocks GCLK1 to GCLK5, and the scan pulses SCAN(0) and SCAN(1) are provided as a pair of clock pulses including a first pulse 33 having a narrow pulse width and a second pulse 34 having a wider pulse width. For example, the pulse width of the second pulse 34 may be 1-horizontal period 1H, but the example embodiment of the present invention is not limited thereto. The shift clocks GCLK1 to GCLK5 may be provided as five-phase clocks whose phases are delayed sequentially.

In the first shift register 82, the first to the third TFTs T21, T22, and T23 charge the Q node Q when the start pulse GVST and the fifth shift clock GCLK5 are input. In the first shift register 82, the start pulse GVST is input to the first stage, and the (N−1)-th scan pulse SCAN(0), which is an output of a previous stage, is input to stages following after the first stage. The fifth shift clock GCLK5 is synchronized with the start pulse GVST and the first pulse 33 of the (N−1)-th scan pulse SCAN(0). The first TFT T21 turns on in response to the start pulse GVST or the (N−1)-th scan pulse SCAN(0). A gate of the first TFT T21 is connected to a start terminal to which the start pulse GVST or the (N−1)-th scan pulse SCAN(0) is input. A drain of the first TFT T21 is connected to a GVDD line to which a high-potential driving voltage GVVD is supplied. A source of the first TFT T21 is connected to a drain of the second TFT T22. The second TFT T22 turns on in response to the fifth shift clock GCLK5. A gate of the second TFT T22 is connected to a GCLK5 line to which the fifth shift clock GCLK5 is input. The drain of the second TFT T22 is connected to the source of the first TFT T21, and a source of the second TFT T22 is connected to a drain of the third TFT T23. The third TFT T23 charges the Q node Q with the high-potential driving voltage GVDD when the first and second TFTs T21 and T22 turn on. A gate of the third TFT T23 is connected to the GVDD line. The drain of the third TFT T23 is connected to the source of the second TFT T22, and a source of the third TFT 23 is connected to the Q node Q.

The fourth TFT T24 connects the Q node Q to the fifth TFTs T25*a* and T25*b* to form a discharge path of the Q node Q. A gate of the fourth TFT T24 is connected to the GVDD line. A drain of the fourth TFT T24 is connected to the Q node Q, and a source of the fourth TFT T14 is connected to the fifth TFTs T25*a* and T25*b*.

The fifth TFTs T25*a* and T25*b* are in a dual-gate structure in which both gates of the fifth TFTs T25*a* and T25*b* are connected to the QB node QB. Accordingly, when a voltage of the QB node QB is at the ON level, the fifth TFTs T25*a* and T25*b* turn on to form a discharge path of the Q node Q. A switch device in a dual-gate structure may increase resistance, thereby reducing a leakage current. A gate of one of the fifth TFTs T25*a* is connected to the QB node QB. A drain of the fifth TFT T25*a* is connected to the Q node Q. A source of the fifth TFT T25*a* is connected to a drain of the other fifth TFT T25*b*. A gate of the other fifth TFT T25*b* is connected to the QB node QB. The drain of the other fifth TFT T25*b* is connected to the source of the fifth TFT T25*a*. A source of the fifth TFT T25*b* is connected to the GVSS line to which a base voltage VGSS or a gate low voltage VGL is supplied.

In response to the third shift clock GCLK3, the sixth TFT T26 outputs a high-potential driving voltage GVDD to the QB node QB. The third shift clock GCLK3 has an earlier phase than the fifth shift clock GCLK5 and does not overlap the fifth shift clock GCLK5. A gate of the sixth TFT T26 is connected to a GCLK3 line to which the third shift clock GCLK3 is input. A drain of the sixth TFT T26 is connected to the GVDD line. A source of the sixth TFT T26 is connected to the QB node QB.

The two seventh TFTs T27*a* and T27*b* constitute a dual-gate structure in which the gates of both seventh TFTs T27*a* and T27*b* are connected to a start terminal. Accordingly, in response to a start pulse GVST or the (N−1)-th scan pulse SCAN(0), the seventh TFTs T27*a* and T27*b* turn on to form a discharge path of the QB node QB. A gate of one of the seventh TFTs T27*a* is connected to the start terminal. A drain of the seventh TFT T27*a* is connected to the QB node QB. A source of the seventh TFT T27*a* is connected to a drain of the other seventh TFT T27*b*. A gate of the other seventh TFT T27*b* is connected to the start terminal. The drain of the seventh TFT T27*b* is connected to the source of the seventh TFT T27*a*. A source of the seventh TFT T27*b* is connected to the GVSS line.

The eighth TFT T28 connects the Q node Q to gates of the two ninth TFTs T29*a* and T29*b* to form a discharge path of the QB node QB when a voltage of the Q node Q is at the ON level. A gate of the eighth TFT T28 is connected to the GVDD line. A drain of the eighth TFT T28 is connected to the Q node Q, and a source of the TFT T28 is connected to the gates of the ninth TFTs T29*a* and T29*b*.

The two ninth TFTs T20*a* and T29*b* constitute a dual-gate structure in which the gates of both of the ninth TFTs T29*a* and T29*b* are connected to the source of the eighth TFT T28 to form a discharge path of the QB node QB when a voltage of the Q node Q is at the ON level. A gate of one of the ninth TFTs 29*a* is connected to the source of the eighth TFT T28. A drain of the ninth TFT T29*a* is connected to the QB node QB. A source of the ninth TFT T29*a* is connected to a drain of the other ninth TFT T29*b*. The gate of the other ninth TFT T29*b* is connected to the source of the ninth TFT T29*a*. The drain of the ninth TFT T29*b* is connected to the source of the ninth TFT T29*a*. A source of the ninth TFT T29*b* is connected to the GVSS line.

The tenth TFT T30 is a pull-up transistor. When the voltage of the Q node (Q) is charged at the ON level, the tenth TFT T30 charges an output node based on the first shift clock GCLK1, thereby causing the N-th scan pulse SCAN (1) to rise. A gate of the tenth TFT T30 is connected to the Q node Q. A drain of the tenth TFT T30 is connected to a GCLK1 line to which the first shift clock GCLK1 is input. A source of the tenth TFT T30 is connected to the output node. A capacitor Cq may be connected between the gate and the source of the tenth TFT T30. The capacitor Cq stores a gate-source voltage Vgs of the tenth TFT T30.

When the voltage of the QB node QB is at the ON level, the eleventh TFT T31 turns on to form a discharge path of the output node, thereby causing the N-th scan pulse SCAN (1) to fall. A gate of the eleventh TFT T31 is connected to the QB node QB. A drain of the eleventh TFT T31 is connected to the output node. A source of the eleventh TFT T31 is connected to the GVSS line.

The second shift register 84 may have a circuit structure substantially identical to that of the first shift register 82. A start pulse DVST and the shift clocks DCLK1 to DCLK5, which are input to the second shift register 84, are respectively synchronized with the first pulse of the start pulse GVST and of the shift clocks GCLK1 to GCLK5, which are input to the first shift register 82, and have phases delayed sequentially.

In the second shift register 84, the first to the third TFTs T41, T42, and T43 charges the Q node Q when the start pulse DVST and the fourth shift clock DCLK4 are input. In the second shift register 84, the start pulse DVST is input to the first stage, and the (N−1)-th duty signal, which is an output of a previous stage, is input to stages following the first stage. The fourth shift clock GCLK4 is synchronized with the start pulse DVST. The first TFT T41 turns on in response to the start pulse DVST or the (N−1)-th duty signal. The second TFT T42 turns on in response to the fourth shift clock DCLK4. When the first and the second TFTs T41 and T42 turn on, the third TFT T43 charges the Q node Q with a high-potential driving voltage DVDD. A gate of the third TFT T43 is connected to a DVDD line.

The fourth TFT T44 connects the Q node Q to the two fifth TFTs T45*a* and T45*b* to form a discharge path of the Q node Q. The fifth TFTs T45*a* and T45*b* have a dual gate structure in which gates of both of the fifth TFTs T45*a* and T45*b* are connected to the QB node QB to form a discharge path of the Q node Q when a voltage of the QB node QB is at the ON level. The sixth TFT T46 outputs a high-potential driving voltage DVDD to the QB node QB in response to the third shift clock DCLK3.

The two seventh TFTs T47*a* and T47*b* have a dual gate structure in which gates of both of the seventh TFTs T47*a* and T47*b* are connected to a start terminal. Accordingly, in response to the start pulse DVST or the (N−1)-th duty signal, the seventh TFTs T47*a* and T47*b* turn on to form a discharge path of the QB node QB. The eighth TFT T48 connects the Q node Q to gates of the two ninth TFTs T49*a* and T 49*b* to form a discharge path of the QB node QB when a voltage of the Q node Q is at the ON level. The ninth TFTs T49*a* and T49*b* have a dual gate structure in which gates of both of the ninth TFTs T49*a* and T49*b* are connected to the source of the eighth TFT T48 to form a discharge path of the QB node QB when the voltage of the Q node Q is at the ON level.

The tenth TFT T50 is a pull-up transistor. When the voltage of the Q node Q is charged at the ON level, the tenth TFT T50 charges an output node in response to the fifth shift clock DCLK5, thereby causing the N-th duty signal DD OUT(1) to rise. The eleventh TFT T51 is a pull-down transistor. When the QB node QB is at the ON level, the eleventh TFT T51 turns on to form a discharge path of the output node, thereby causing the N-th duty signal DD OUT (1) to fall.

The third shift register 80 has substantially the same circuit structure as that of an EM driver shown in FIG. 11, except that the eleventh TFT T81 is further added. The third shift register 80 is different from the EM driver shown in FIG. 11 additionally because the third shift register 80 receives the scan signal SCAN(1) and the duty signal DD OUT(1), which are unrelated to and not used for writing image data to the pixels.

The first and the second TFTs T71 and T72 of the third shift register charge the Q node Q with a high-potential driving voltage EVDD when the (N−1)-th EM signal EMO (0), or a start pulse EVST in the first stage, is at the ON level and the first shift clock ECLK1 is at the ON level. In response to the N-th scan pulse SCAN(1), the third TFT T73 charges the QB node QB with a reset signal ERST. The N-th scan pulse SCAN(1) is provided independent of the scan pulses SCAN1 and SCAN2 which are used for writing data to the pixels, so that the N-th scan pulse SCAN(1) does not affect the data to be written to the pixels.

When the N-th EM signal EMO(1) is output at the ON level via an output node, the fourth TFT T74 charges a node between the ninth and the tenth TFTs T79 and T89 with a high-potential driving voltage EVDD. In response to the third shift clock ECLK3, the fifth TFT T75 charges the QB node QB with a voltage of the (N−1)-th scan pulse SCAN (0), or the start pulse GVST in the first stage, thereby causing the N-th EM signal EMO(1) to fall in a scanning period.

When the voltage of the QB node QB is at the ON level, the sixth TFT T76 turns on to discharge the Q node Q. In response to the first shift clock ECLK1, the seventh TFT T77 forms a discharge path of the QB node QB.

When the duty signal DD OUT(1) is at the ON level, the eleventh TFT T81 turns on to charge the QB node QB with the high-potential driving voltage EVDD. As a result, the output node of the third shift register 80 is discharged, and the N-th EM signal EMO(1) falls to the OFF level. A gate of the eleventh TFT T81 is connected to an output node of the second shift register 84 to receive the duty signal DD OUT(1). A drain of the eleventh TFT T81 is connected to the EVDD line, and a source of the eleventh TFT T81 is connected to the QB node QB.

The eighth TFT T78 is a pull-up transistor. The eighth TFT T78 charges the output node to the high-potential driving voltage EVDD based on a voltage of the Q node Q, thereby causing the N-th EM signal EMO(1) to rise. The ninth and the tenth TFTs T79 and T80 constitute a pull-down transistor. When the voltage of the QB node is at the ON level, the ninth and the tenth TFTs T79 and T80 turn on to form a discharge path of the output node, thereby causing the N-th EM signal EMO(1) to fall.

The N-th EM signal EMO(1) is synchronized with the (N−1)-th scan pulse SCAN(0) in the scanning period to be provided at the OFF level. The fifth TFT T75 turns on based on the ON-level voltage of the (N−1)-th scan pulse SCAN (0), or the start pulse GVST in the first stage. Then, the N-th EM signal EMO(1) is output at the ON level based on the first shift clock ECLK1, and on the (N−1)-th EM signal EMO(0) or the start pulse EVST in the first stage. The first TFT T71 turns on in response to the first shift clock ECLK1, and the second TFT T72 turns on in response to the (N−1)-th EM signal EM0(0), or the start pulse EVST in the first stage. Then, the N-th EM signal EMO(1) falls to the OFF level based on the N-th scan pulse SCAN(1) and a reset signal ERST because the third TFT T73 turns on in response to the N-th scan pulse SCAN(1) to charge the QB node QB with an ON-level voltage of the reset signal ERST. Then, the N-th EM signal EMO(1) switches again to the ON level based on the shift clock ECLK1 and the (N−1)-th EM signal EM0(0), or the start pulse EVST, that respectively turn on the first and the second TFTs T71 and T72.

In a duty driving period, the N-th EM signal EMO(1) is set to the OFF level in synchronization with the N-th duty signal DD OUT(1) rising to the ON level. When the (N−1)-th EM signal EMO(0) and the first shift clock ECLK1 are both at the ON level, the N-th EM signal EMO(1) is switched back to the ON level.

The example embodiment of the present invention uses scan pulses (or additional signals) and shift clocks, which are unrelated to writing data to the pixels, to control a timing of an OFF-level section or sections of an EM signal in a duty driving period. Accordingly, it is possible to prevent the image data to be written to pixels from being undesirably changed, and to control an OFF-level section or sections to be as long as desired. As a result, the example embodiment of the present invention allows for driving an organic light emitting display with a duty control method.

It will be apparent to those skilled in the art that various modifications and variations can be made in the organic light emitting display and the method of driving the same according to the present invention as described herein without departing from the spirit or scope of the invention. Thus, it is intended that the present invention cover the modifications and variations of this invention as described herein provided they come within the scope of the appended claims and their equivalents.

What is claimed is:

1. An organic light emitting display, comprising:

a display panel having a plurality of data lines, a plurality of scan lines crossing the data lines, a plurality of emission signal lines, and a pixel connected to an N-th scan line and an N-th emission signal line, where N is a positive integer, the pixel including:

an organic light emitting diode (OLED); and a first pixel TFT connected to the OLED and configured to control an amount of current to flow through the OLED based on a voltage between a gate and a source of the first pixel TFT;

a data driver configured to provide a data voltage corresponding to an input image to one of the data lines connected to the pixel;

a gate driver configured to provide an N-th scan pulse to the N-th scan line to charge the pixel with the data voltage during a scan period within a frame period; and an emission driver configured to receives shift clocks and the N-th scan pulse from the gate driver to provide an N-th emission control signal to the N-th emission signal line and to control a current path through the OLED based on the N-th emission control signal during a duty driving period following the scan period within the frame period, wherein the voltage between the gate and the source of the first pixel TFT is configured to remain substantially constant during the duty driving period, wherein the emission driver includes a shift register comprising:

an output node configured to output the N-th emission control signal;

a Q node and a QB node;

a pull-up transistor having a gate connected to the Q node and a source connected to the output node, and configured to charge the output node to a high-potential driving voltage to set the N-th emission control signal to an ON level based on a voltage at the Q node;

a capacitor connected between the gate and the source of the pull-up transistor;

a pull-down transistor configured to discharge the output node to a base voltage to set the N-th emission control signal to an OFF level based on a voltage at the QB node;

a first TFT and a second TFT configured to charge the Q node to the ON level base on a first shift clock and a (N−1)-th emission control signal;

a third TFT configured to charge the QB node to a reset signal based on the N-th scan pulse;

a fourth TFT configured to charge a node between two TFTs in the pull-down transistor to the high-potential driving voltage;

a fifth TFT configured to charge the QB node based on a (N−1)-th scan pulse from the gate driver and a second shift clock;

a sixth TFT configured to discharge the Q node to the base voltage based on the voltage at the QB node; and a seventh TFT configured to discharge the QB node to the base voltage based on the first shift clock.

2. The display of claim 1, wherein each of the first shift clock and the second shift clock is configured as a pair of clock pulses, and wherein the pair of clock pulses of the first shift clock does not overlap the pair of clock pulses of the second shift clock.

3. The display of claim 1, wherein the N-th emission control signal is a pulse width modulated signal configured to swing between an OFF level and an ON level according to a duty ratio, and wherein the N-th emission control signal switches from the OFF level to the ON level at least twice during the duty driving period.

4. The display of claim 3, wherein the N-th scan pulse includes a first scan pulse and a second scan pulse, wherein the pixel further includes:

a storage capacitor connected between the gate and the source of the first pixel TFT; and a second pixel TFT connected between a high-potential driving voltage line and the first pixel TFT, and configured to turn on or off based on the N-th emission control signal to control the current path through the OLED, and wherein the second pixel TFT is configured to turn off at least once based on the N-th emission control signal being at the OFF level to block the current path through the OLED at least once during the duty driving period, and the voltage between the gate and the source of the first pixel TFT remains substantially constant regardless of whether the second pixel TFT is turned on or off.

5. The display of claim 4, wherein the pixel further includes:

a third pixel TFT configured to supply a reference voltage or the data voltage to the gate of the first pixel TFT based on the first scan pulse during the scan period and to be turned off during the duty driving period; and a fourth pixel TFT configured to supply a predetermined initial voltage to the source of the first pixel TFT base on the second scan pulse.

6. An organic light emitting display, comprising:

a display panel having a plurality of data lines, a plurality of scan lines crossing the data lines, a plurality of emission signal lines, and a pixel connected to an N-th scan line and an N-th emission signal line, where N is a positive integer;

a timing controller configured to receive an input image data and timing signals from a host system, and to output a data timing control signal, a gate timing control signal, and a plurality of duty timing control signals;

a data driver configured to provide a data voltage corresponding to the input image data to one of the data lines connected to the pixel based on the data timing control signal;

a gate driver configured to provide a data-writing scan pulse to the N-th scan line based on the gate timing control signal to charge the pixel with the data voltage during a scan period within a frame period; and an emission driver configured to generate an N-th scan pulse independently of the gate driver, and to provide an N-th emission control signal to the N-th emission signal line based on the N-th scan pulse and at least one of the duty timing control signals, during a duty driving period following the scan period within the frame period, wherein the emission driver includes:

a first shift register configured to generate the N-th scan pulse based on a first set of shift clocks;

a second shift register configured to generate an N-th duty signal based on a second set of shift clocks; and a third shift register configured to receive the N-th scan pulse and the N-th duty signal, and to output the N-th emission control signal based on the N-th scan pulse, the N-th duty signal, and a third set of shift clocks, and wherein the duty timing control signals include one or more shift clocks in the first to the third sets of shift clocks.

7. The display of claim 6, wherein the third shift register includes:

an output node configured to output the N-th emission control signal;

a Q node and a QB node;

a pull-up transistor having a gate connected to the Q node and a source connected to the output node, and configured to charge the output node to a high-potential driving voltage to set the N-th emission control signal to an ON level based on a voltage at the Q node;

a capacitor connected between the gate and the source of the pull-up transistor; and a pull-down transistor configured to discharge the output node to a base voltage to set the N-th emission control signal to an OFF level based on a voltage at the QB node.

8. The display of claim 7, wherein:

the first shift register is further configured to generate an (N−1)-th scan pulse based on the first set of shift clocks;

the third set of shift clocks include a first shift clock and a second shift clock; and the third shift register is further configured to output an (N−1)-th emission control signal to an (N−1)-th emission signal line, and to receive a reset signal from the timing controller, the third shift register further including:

a first TFT and a second TFT configured to charge the Q node to the ON level base on the first shift clock and the (N−1)-th emission control signal;

a third TFT configured to charge the QB node to the reset signal based on the N-th scan pulse;

a fourth TFT configured to charge a node between two TFTs in the pull-down transistor to the high-potential driving voltage;

a fifth TFT configured to charge the QB node based on the (N−1)-th scan pulse and the second shift clock;

a sixth TFT configured to discharge the Q node to the base voltage based on the voltage at the QB node; and a seventh TFT configured to discharge the QB node to the base voltage based on the first shift clock.

9. The display of claim 8, wherein each of the (N−1)-th scan pulse and the N-th scan pulse is configured as a pair of pulses including a first pulse followed by a second pulse wider than the first pulse.

10. The display of claim 8, wherein each of the first shift clock and the second shift clock is configured as a pair of clock pulses, and wherein the pair of clock pulses of the first shift clock does not overlap the pair of clock pulses of the second shift clock.

11. The display of claim 8, wherein:

the pull-up transistor includes an eighth TFT;

the pull-down transistor includes a ninth TFT and a tenth TFT connected to each other; and the third shift register further includes an eleventh TFT configured to charge the QB node to the high-potential driving voltage based on the N-th duty signal.

12. The display of claim 6, wherein the N-th emission control signal is a pulse width modulated signal configured to swing between an OFF level and an ON level according to a duty ratio, and wherein the N-th emission control signal is configured to switch from the OFF level to the ON level at least twice during the duty driving period.

13. The display of claim 12, wherein the pixel includes:

an organic light emitting diode (OLED); and a first pixel TFT connected to the OLED and configured to control an amount of current to flow through the OLED based on a voltage between a gate and a source of the first pixel TFT, wherein the voltage between the gate and the source of the first pixel TFT is configured to remain substantially constant during the duty driving period.

14. The display of claim 13, wherein the pixel further includes:

a storage capacitor connected between the gate and the source of the first pixel TFT; and a second pixel TFT connected between a high-potential driving voltage line and the first pixel TFT, and configured to turn on or off based on the N-th emission control signal to control a current path through the OLED to turn the OLED on or off, wherein the second pixel TFT is configured to turn off at least once based on the N-th emission control signal being at the OFF level to block the current path through the OLED at least once during the duty driving period, and the voltage between the gate and the source of the first pixel TFT is configured to remain substantially constant regardless of whether the second pixel TFT is turned on or off.

15. An organic light emitting display, comprising:

a display panel having a plurality of data lines, a plurality of scan lines crossing the data lines, a plurality of emission signal lines, and a pixel connected to an N-th scan line and an N-th emission signal line, where N is a positive integer;

a timing controller configured to receive an input image data and timing signals from a host system, and to output a data timing control signal, a gate timing control signal, and a plurality of duty timing control signals;

a data driver configured to provide a data voltage corresponding to the input image data to one of the data lines connected to the pixel based on the data timing control signal;

a gate driver configured to provide a data-writing scan pulse to the N-th scan line based on the gate timing control signal to charge the pixel with the data voltage during a scan period within a frame period; and an emission driver configured to provide an N-th emission control signal to the N-th emission signal line based on at least one of the duty timing control signals during a duty driving period following the scan period within the frame period, the N-th emission control signal being a pulse width modulated signal configured to swing between an ON level and an OFF level, wherein the emission driver is configured to switch the N-th emission control signal from the OFF level to the ON level at least twice during the duty driving period, and wherein the emission driver includes a shift register comprising:

an output node configured to output the N-th emission control signal;

a Q node and a QB node;

a pull-up transistor having a gate connected to the Q node and a source connected to the output node, and configured to charge the output node to a high-potential driving voltage to set the N-th emission control signal to the ON level based on a voltage at the Q node;

a capacitor connected between the gate and the source of the pull-up transistor;

a pull-down transistor configured to discharge the output node to a base voltage to set the N-th emission control signal to the OFF level based on a voltage at the QB node;

a first TFT and a second TFT configured to charge the Q node to the ON level base on a first shift clock and a (N−1)-th emission control signal;

a third TFT configured to charge the QB node to a reset signal based on the N-th scan pulse;

a fourth TFT configured to charge a node between two TFTs in the pull-down transistor to the high-potential driving voltage;

a fifth TFT configured to charge the QB node based on a (N−1)-th scan pulse from the gate driver and a second shift clock;

a sixth TFT configured to discharge the Q node to the base voltage based on the voltage at the QB node; and a seventh TFT configured to discharge the QB node to the base voltage based on the first shift clock.

16. The display of claim 15, wherein the pixel includes an organic light emitting diode (OLED), and wherein the N-th emission control signal is configured to form a current path through the OLED when at the ON level, and to block the current path through the OLED when at the OFF level.

17. The display of claim 16, wherein the pixel further includes:

a first pixel TFT connected to the OLED and configured to control an amount of current to flow through the OLED based on a voltage between a gate and a source of the first pixel TFT;

a storage capacitor connected between the gate and the source of the first pixel TFT; and a second pixel TFT connected between a high-potential driving voltage line and the first pixel TFT, and configured to turn on or off based on the N-th emission control signal to control the current path through the OLED, wherein the second pixel TFT is configured to turn off based on the N-th emission control signal being at the OFF level to block the current path through the OLED at least twice during the duty driving period, and the voltage between the gate and the source of the first pixel TFT is configured to remain substantially constant regardless of whether the second pixel TFT is turned on or off.

* * * * *